US009737114B2

(12) United States Patent
Beye et al.

(10) Patent No.: US 9,737,114 B2
(45) Date of Patent: Aug. 22, 2017

(54) ARTICLES OF FOOTWEAR WITH UPPER INCORPORATING CHAMBER ELEMENT

(71) Applicant: NIKE, Inc., Beaverton, OR (US)

(72) Inventors: Douglas A. Beye, Beaverton, OR (US); Eric Joseph Marshall, Taulatin, OR (US)

(73) Assignee: NIKE, Inc., Beaverton, OR (US)

( * ) Notice: Subject to any disclaimer, the term of this patent is extended or adjusted under 35 U.S.C. 154(b) by 119 days.

(21) Appl. No.: 14/453,501

(22) Filed: Aug. 6, 2014

(65) Prior Publication Data

US 2016/0037862 A1 Feb. 11, 2016

(51) Int. Cl.

| | |
|---|---|
| ***A43B 23/02*** | (2006.01) |
| ***A43B 1/00*** | (2006.01) |
| ***A43B 7/20*** | (2006.01) |

(52) U.S. Cl.

CPC ..... *A43B 23/029* (2013.01); *A43B 1/0027* (2013.01); *A43B 1/0072* (2013.01); *A43B 7/20* (2013.01); *A43B 23/0235* (2013.01); *A43B 23/0285* (2013.01)

(58) Field of Classification Search

CPC . A43B 23/028; A43B 23/0285; A43B 23/029; A43B 23/086; A43B 23/17; A43B 23/08; A43B 23/022; A43B 23/0235; A43B 5/0407; A43B 1/0072; A43B 7/20; A43B 1/0027; A43B 3/0078; A43B 3/001

USPC ..... 36/93, 71, 88, 89, 114, 115, 133, 10

See application file for complete search history.

(56) References Cited

U.S. PATENT DOCUMENTS

| | | | | |
|---|---|---|---|---|
| 746,338 | A * | 12/1903 | Keen | A43B 5/0407 128/DIG. 20 |
| 3,410,004 | A | 11/1968 | Finn | |
| 3,736,612 | A | 6/1973 | Check et al. | |
| 4,724,627 | A | 2/1988 | Sisco | |
| 4,837,960 | A * | 6/1989 | Skaja | A43B 23/00 36/136 |
| 5,113,599 | A * | 5/1992 | Cohen | A43B 17/035 36/114 |
| 5,295,313 | A | 3/1994 | Lee | |

(Continued)

FOREIGN PATENT DOCUMENTS

| | | |
|---|---|---|
| DE | 3805591 | 8/1989 |
| EP | 94868 | 11/1983 |

(Continued)

OTHER PUBLICATIONS

International Search Report and Written Opinion for PCT Application No. PCT/US2015/032822, mailed Sep. 30, 2015.

*Primary Examiner* — Khoa Huynh
*Assistant Examiner* — Griffin Hall
(74) *Attorney, Agent, or Firm* — Honigman Miller Schwartz and Cohn LLP; Matthew H. Szalach; Jonathan P. O'Brien

(57) ABSTRACT

An article of footwear may include an upper with an outer layer, an inner layer, and a chamber element positioned at least partially between the outer layer and the upper layer. The chamber element may be formed of two layers of a transparent colored polymer material and may be sealed to enclose a fluid. The chamber element may also have a plurality of subchambers. The outer layer may have a plurality of apertures. Each subchamber may protrude at least partially through a corresponding one of the apertures.

23 Claims, 24 Drawing Sheets

(56) References Cited

U.S. PATENT DOCUMENTS 5,343,638 A * 9/1994 Legassie ..... A43B 3/0005 36/28
5,379,533 A * 1/1995 Swartz ..... A43B 1/0036 36/136
5,416,988 A 5/1995 Potter et al.
5,430,961 A 7/1995 Faulconer et al.
5,513,448 A 5/1996 Lyons
5,528,841 A * 6/1996 Pozzobon ..... A43B 5/0405 36/115
5,617,650 A 4/1997 Grim
D394,744 S * 6/1998 Ng ..... D2/900
5,765,298 A 6/1998 Potter et al.
5,839,211 A * 11/1998 Pallera ..... A43B 1/0072 36/136
5,985,383 A 11/1999 Allen et al.
5,987,779 A * 11/1999 Litchfield ..... A43B 13/203 36/29
6,115,948 A * 9/2000 Mitchell ..... A41D 27/08 2/245
7,278,445 B2 * 10/2007 Marvin ..... A43B 1/0072 137/601.2
7,325,337 B2 * 2/2008 Cox ..... A43B 1/0027 36/100
7,421,806 B2 9/2008 Braynock et al.
7,478,488 B1 * 1/2009 Davis ..... A43B 7/081 36/29
8,161,665 B2 * 4/2012 Nakano ..... A43B 19/00 36/55
8,904,675 B2 * 12/2014 Koch ..... A43B 1/0072 36/100
2006/0143951 A1 * 7/2006 Yang ..... A43B 3/0078 36/100
2008/0141433 A1 * 6/2008 Rhodes-Vivour ..... A42B 1/004 2/69
2010/0180469 A1 * 7/2010 Baucom ..... A43B 3/0031 36/100
2010/0192419 A1 * 8/2010 Jack ..... A43B 1/0054 36/132
2012/0199222 A1 8/2012 Sullivan et al.
2012/0297643 A1 * 11/2012 Shaffer ..... A43B 1/0027 36/83
2013/0227857 A1 * 9/2013 Schindler ..... A43B 23/029 36/83
2015/0290849 A1 * 10/2015 Hochdoerffer ..... B29D 35/146 264/46.5

FOREIGN PATENT DOCUMENTS

EP 2494879 A1 9/2012
FR 2717350 9/1995
JP 05095804 4/1993
WO 9505761 3/1995
WO 02098256 12/2002

* cited by examiner

ARTICLES OF FOOTWEAR WITH UPPER INCORPORATING CHAMBER ELEMENT

BACKGROUND

Improvements in footwear technology may have benefits for a variety of activities. Footwear design may benefit wearers for purposes of ordinary, day-to-day use. Footwear design may also benefit wearers who work in physically challenging conditions requiring bodily protection, or engage in recreational outdoor activities such as hiking or fishing. Some improvements in footwear technology may be advantageous to generally athletic activities such as running, or to specific sports, such as football, baseball, basketball, hockey, soccer, tennis, golf, lacrosse, or cricket.

An article of footwear may in turn have various parts subject to improvement. For example, a conventional article of footwear may include an upper and a sole structure. The upper may be formed from one or more of a variety of material elements (e.g. textiles, leather, synthetic leather, and foam materials), and may define a void that securely receives the foot of a wearer and positions it with respect to the sole structure. The sole structure may be secured to a lower surface of the upper, and may have a layered configuration that includes a comfort-enhancing insole, a resilient midsole formed from a polymer foam, and a ground-contacting outsole.

A polymer foam material within a sole structure may include a plurality of open or closed cells that deteriorate following repeated compressions. The effects of this deterioration may be decreased by incorporating a fluid-filled chamber into the sole structure. The chamber may be formed from a polymer material that is sealed to enclose a fluid, and may be encapsulated within the polymer material, or may be located above or below it, or may form any portion of the midsole. Fluid-filled chambers suitable for such footwear applications may be manufactured by thermoforming techniques.

The sole structure may serve to attenuate ground reaction forces, to provide traction, and to control various foot motions such as pronation. The upper and the sole structure may cooperatively provide a comfortable structure to benefit a wearer engaged in any of a variety of activities.

Meanwhile, an individual wearing an article of footwear and engaged in an athletic activity or sport may make sudden stops or changes of direction, which may subject the upper of the footwear to various deforming forces. For example, an individual playing a game of football or basketball may need to rapidly change direction to avoid another player. Such movements may subject an article of footwear to various deforming forces, and may also subject an ankle of the individual to various stresses.

At the same time, an individual may be a member of a team, or may be one individual competitor among many individual competitors. Whether as an individual competitor or a part of a team, the individual may benefit from an increased ability to identify themselves. Identification may help team-mates locate an individual playing on a field, for example, to the benefit of the team during the game. Similarly, individual players may also benefit from being made more easily recognizable to referees, coaching staff, or others.

Therefore, there exists a need in the footwear art for improvements that may mitigate various deforming forces to which an article of footwear may be subjected and various stressing forces to which an ankle of an individual may be subjected. There also exists a need for improvements that may help to identify an individual wearing the article of footwear.

SUMMARY

Uppers for articles of footwear that include chamber elements are described below. Including a fluid-filled chamber within the structure of the footwear upper provides an added degree of comfort, cushioning, fit and support to the wearer's foot. For example, in activities that require sudden stop-and-go-movements or lateral cutting movements, an upper having a chamber that surrounds the Achilles tendon area of the heel and ankle could provide added stability, support and recovery from a stretched or angled position of the foot. Meanwhile, the incorporation of one or more colors into exposed portions of a fluid-filled chamber within a footwear upper expands the potential aesthetic qualities of the footwear as well as increasing the footwear's potential value as identification or insignia. Footwear and uppers incorporating such chambers may therefore mitigate deforming forces or stressing forces, or assist in personalizing or customizing an article of footwear, or both.

In one aspect, the invention provides an article of footwear having an upper and a sole structure. The upper defines an interior void for receiving a foot of a wearer and comprises an outer layer, an inner layer, and a chamber element. The outer layer forms part of an exterior surface of the article of footwear and has at least one aperture positioned in a rearfoot region of the footwear. The inner layer is attached to the outer layer and is positioned adjacent the interior void to form part of an interior surface of the footwear. The chamber element is sealed to enclose a fluid and is positioned at least partially between the outer layer and the inner layer. The chamber element has at least a portion that protrudes at least partially through the aperture.

In another aspect, the invention provides an article of footwear having an upper and a sole structure. The upper defines an interior void for receiving a foot of a wearer and comprises an outer layer, an inner layer, and a sealed fluid-filled chamber element. The outer layer forms part of an exterior surface of the footwear and has at least one aperture. The inner layer is positioned opposite the outer layer and forms part of an interior surface of the footwear. The sealed fluid-filled chamber element includes a first barrier layer and a second barrier layer and is positioned at least partially between the outer layer and the inner layer. The chamber element includes a subchamber protruding at least partially through the aperture to form part of the exterior surface. The subchamber is at least partially formed from a colored material.

In yet another aspect, the invention provides an upper of an article of footwear that comprises an outer layer and a sealed fluid-filled chamber element. The outer layer forms part of an exterior surface of the footwear. The chamber element is positioned to contact the outer layer and surrounds a heel region of the footwear. The chamber element has a protrusion extending rearward through an aperture in the outer layer to form part of the exterior surface. The protrusion includes a colored material.

In a further aspect, the invention provides an article of footwear having an upper and a sole structure. The upper defines an interior void for receiving a foot of a wearer and comprises an outer layer, an inner layer, and a fluid-filled chamber. The outer layer forms part of an exterior surface of the footwear and has a plurality of apertures. At least one of the apertures is positioned at a rearward-facing portion of a heel region of the footwear. The inner layer is positioned adjacent the interior void and forms part of an interior surface of the footwear. The fluid-filled chamber element is positioned at least partially between the outer layer and the inner layer. The chamber element includes an interior bond and a plurality of subchambers. The interior bond is positioned on one of a lateral side of the upper and a medial side of the upper. The plurality of subchambers is positioned adjacent to at least fifty percent of a periphery of the interior bond. The subchambers are in fluid communication with each other, and each of the subchambers protrudes at least partially through one of the apertures.

In another aspect, the invention provides an article of footwear having an upper and a sole structure. The upper defines an interior void for receiving a foot of a wearer and comprises an outer layer, an inner layer, and a fluid-filled chamber element. The outer layer forms part of an exterior surface of the footwear and has a plurality of apertures. At least one of the apertures is positioned at a rearward-facing portion of a heel region of the footwear. The inner layer is positioned adjacent the interior void and forms part of an interior surface of the footwear. The fluid-filled chamber element is at least partially formed from a transparent colored polymer material and is positioned at least partially between the outer layer and the inner layer. The chamber element includes a heel subchamber, a plurality of lateral subchambers, a plurality of medial subchambers, a lateral internal bond, and a medial internal bond. The heel subchamber and the plurality of lateral subchambers are adjacent to at least fifty percent of a periphery of the lateral internal bond, and the heel subchamber and the plurality of medial subchambers are adjacent to at least fifty percent of a periphery of the medial internal bond.

In yet another aspect, the invention provides an article of footwear having an upper and a sole structure. The upper includes an exterior surface facing outward from the footwear and an interior surface defining an interior void for receiving a foot of a wearer. The upper comprises a chamber element sealed to enclose a fluid, the chamber element surrounding a heel region of the footwear and forming at least 80 percent of the exterior surface of the upper in the heel region.

In a further aspect, the invention provides an article of footwear having an upper and a sole structure. The upper defines an interior void for receiving a foot of a wearer. The upper comprises a material layer and a fluid-filled chamber element. The material layer has a forward portion that forms part of an exterior surface of the upper in a forefoot region of the footwear. The fluid-filled chamber element forms part of the exterior surface of the upper in both a midfoot region of the footwear and a heel region of the footwear. The chamber element has a first barrier layer and a second barrier layer that define a plurality of subchambers. Each subchamber is exposed to an exterior of the footwear and is at least partially formed from a colored material.

In another aspect, the invention provides an article of footwear having an upper and a sole structure. The upper defines an interior void for receiving a foot of a wearer. The upper comprises a material layer and a fluid-filled chamber element. The material layer has a forward portion defining the interior void in a forefoot region of the footwear and a rearward portion defining the interior void in both a midfoot region of the footwear and a heel region of the footwear. The fluid-filled chamber element is secured to an outer surface of the rearward portion of the material layer. The chamber element includes a plurality of subchambers. The chamber element is at least partially formed from a transparent colored polymer material.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The following discussion and accompanying figures disclose various configurations of uppers and chamber elements with reference to footwear having a configuration that is suitable for an athletic activity or sport in which a participant may make sudden stops or changes of direction, such as football, basketball, tennis, or soccer. However, concepts associated with the uppers and chamber elements may be applied to a wide range of athletic or sport-related footwear styles, including casual footwear, walking shoes, golf shoes, cross-training shoes, hiking shoes and boots, and ski and snowboarding boots, for example. Associated concepts may also be utilized with footwear styles that are generally considered to be non-athletic, including dress shoes and loafers. Accordingly, uppers and chamber elements incorporating the concepts disclosed herein may be utilized within a variety of articles of footwear.

General Footwear Structure

Figure 1:
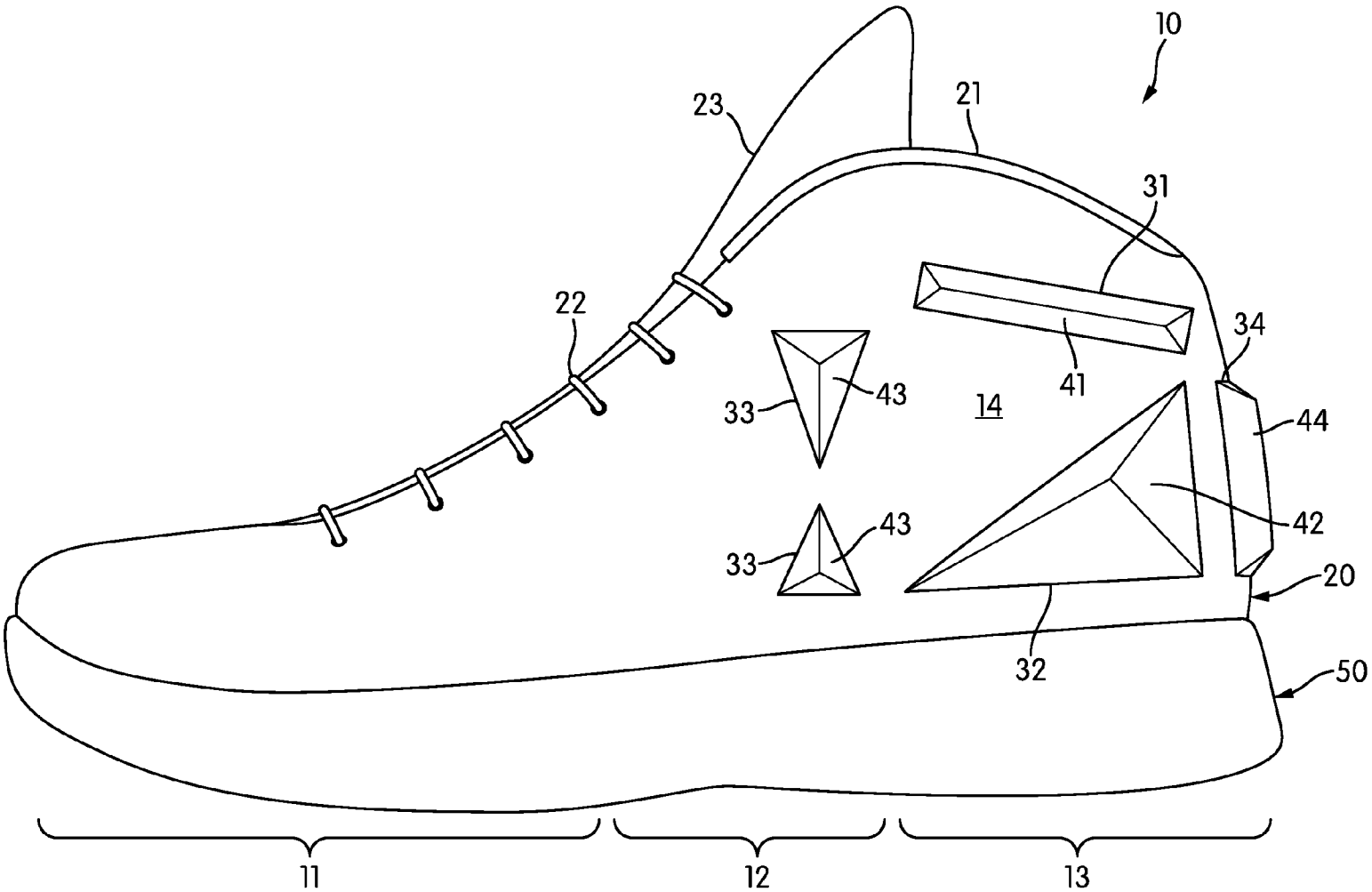
FIG. 1 is a lateral side elevational view of an article of footwear having an upper incorporating a chamber element.
Figure 2:
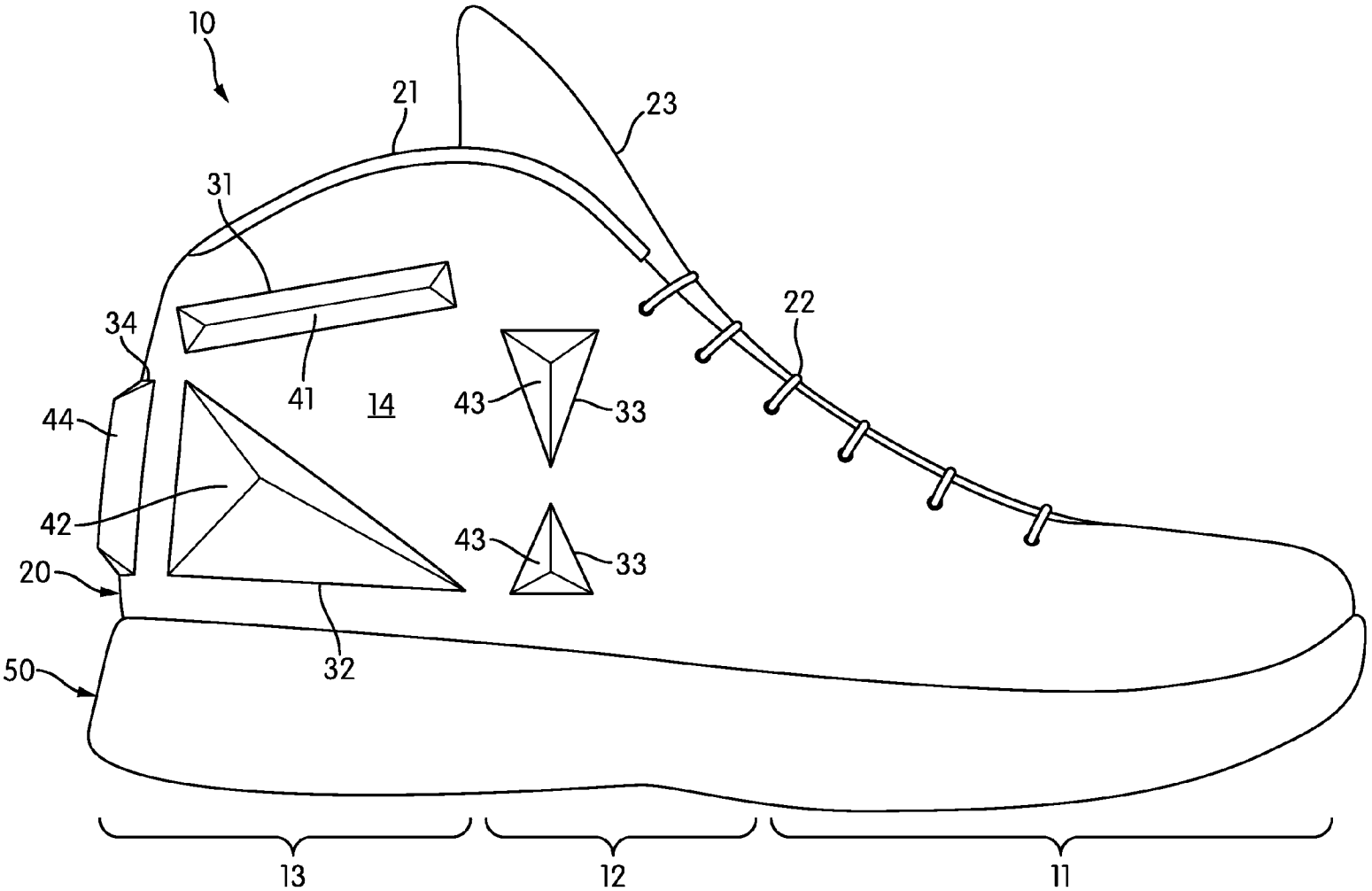
FIG. 2 is a medial side elevational view of the article of footwear.
Figure 3:
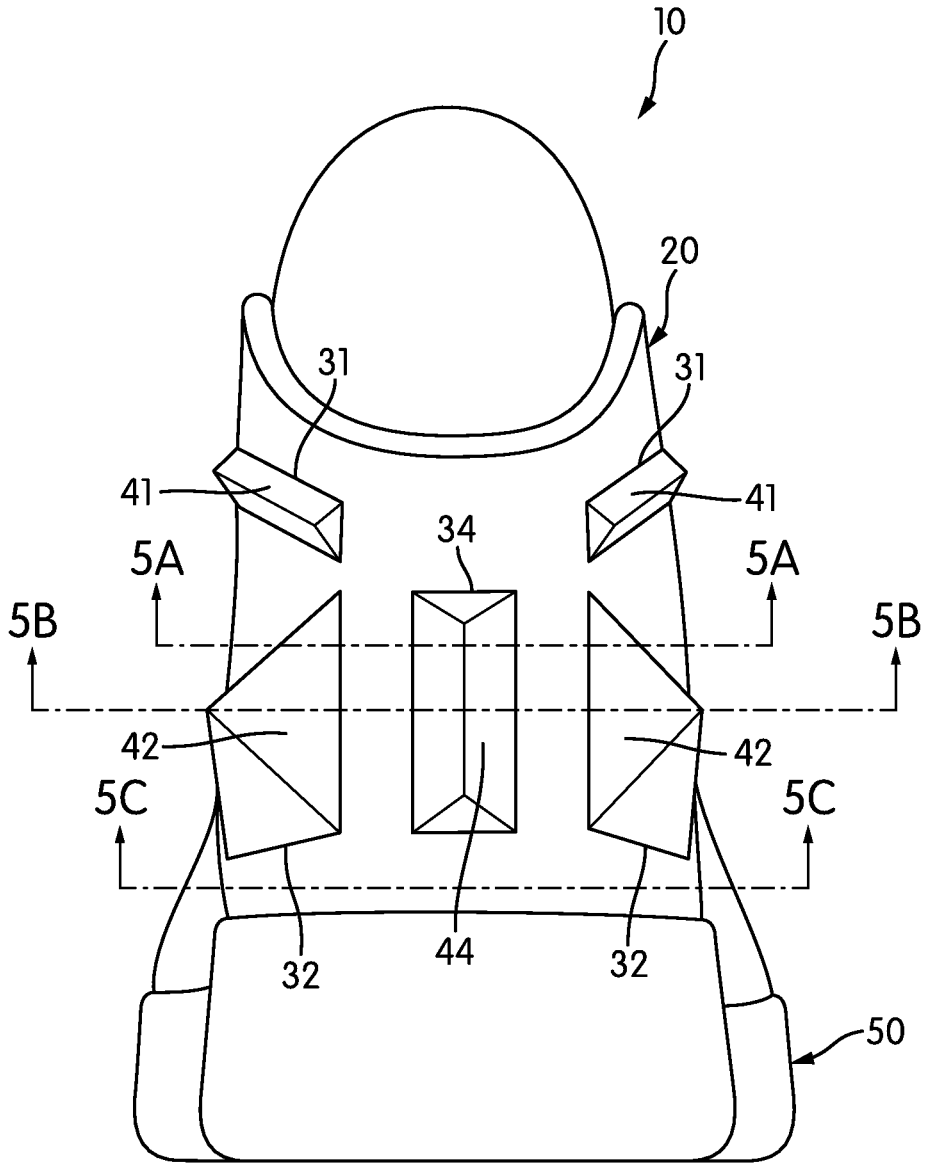
FIG. 3 is a rear elevational view of the article of footwear.
Figure 4:
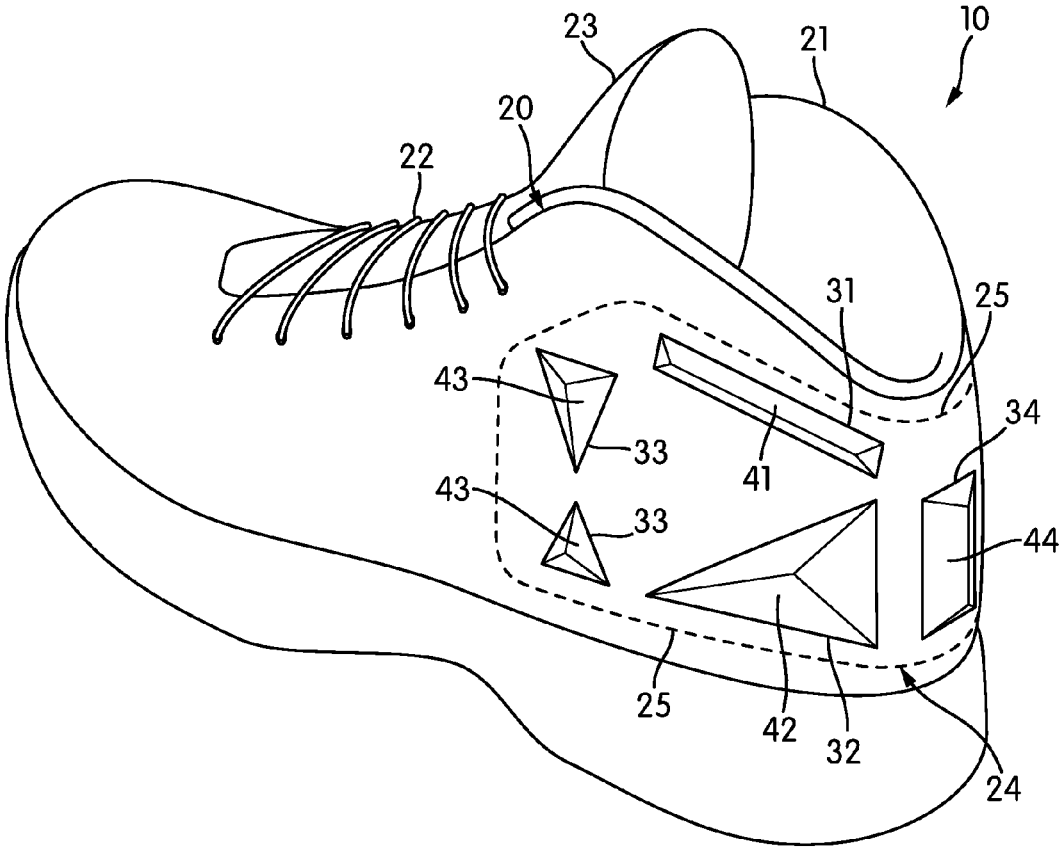
FIG. 4 is a perspective view of the article of footwear.

An article of footwear 10 is depicted in FIGS. 1-5C as including an upper 20 for receiving a foot of a wearer and a sole structure 50. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 50, and individual elements thereof, such as chamber element 24.

Upper 20 is depicted as having a substantially conventional configuration incorporating a plurality of material elements (e.g., textile, foam, leather, and synthetic leather) that are stitched, adhered, bonded, or otherwise joined together to form an interior void for securely and comfortably receiving a wearer's foot. The material elements may be selected and located with respect to upper 20 in order to selectively impart properties of durability, air-permeability, wear-resistance, flexibility, and comfort, for example. An opening 21 in heel region 13 provides access to the interior void.

Upper 20 includes a lace element 22 that is utilized in a conventional manner to modify the dimensions of the interior void, thereby securing the foot within the interior void and facilitating entry and removal of the foot from the interior void. Lace element 22 may extend through apertures in upper 20, and a tongue portion 23 of upper 20 may extend between the interior void and lace element 22. However, in some configurations, footwear 10 may incorporate other structures that function as lace element 22. Upper 20 incorporates a sealed fluid-filled chamber element 24. Upper 20 may also incorporate a sockliner adjacent a plantar (i.e., lower) surface of the foot to enhance the comfort of footwear 10.

Sole structure 50 is secured to upper 20 and has a configuration that extends between upper 20 and the ground, and thus effectively extends between the foot and the ground. Sole structure 50 may include a midsole formed from a polymer foam material, such as polyurethane or ethylvinylacetate, and sole structure 50 may also incorporate one or more additional footwear elements that enhance the comfort, performance, or ground reaction force attenuation properties of footwear 10, including fluid-filled chambers, plates, moderators, lasting elements, or motion control members. Sole structure 50 may also include an outsole secured to a lower surface of the midsole. The outsole may be formed from a material that provides a durable and wear-resistant surface for engaging the ground, and may be textured to enhance the traction (i.e., friction) properties between footwear 10 and the ground, such as rubber materials. In addition to attenuating ground reaction forces, i.e., providing cushioning for the foot, sole structure 50 may provide traction, impart stability, and limit various foot motions, such as pronation.

Given that various aspects of the present application primarily relate to upper 20, sole structure 50 may exhibit the general configuration discussed above or the general configuration of practically any other conventional or non-conventional sole structure. As a result, the overall configuration of sole structure 50 may vary significantly.

First Upper and Chamber Element Configuration

FIGS. 1-8 depict a first configuration of footwear 10 and an upper and chamber element incorporated therein. As incorporated into footwear 10 and illustrated in FIGS. 1-5C, chamber element 24 has a shape that surrounds a rearfoot region or heel region 13 of footwear 10. That is, chamber element 24 extends from lateral side 14 of footwear 10, around heel region 13, and into medial side 15 of footwear 10. Chamber element 24 is depicted as extending beyond heel region 13 toward forefoot region 11 and into midfoot region 12 (that is, in a forefoot direction of footwear 10). However, in some configurations chamber element 24 may extend beyond midfoot region 12 and into forefoot region 11, while in other configurations chamber element 24 may not extend into midfoot region 12.

Figure 9:
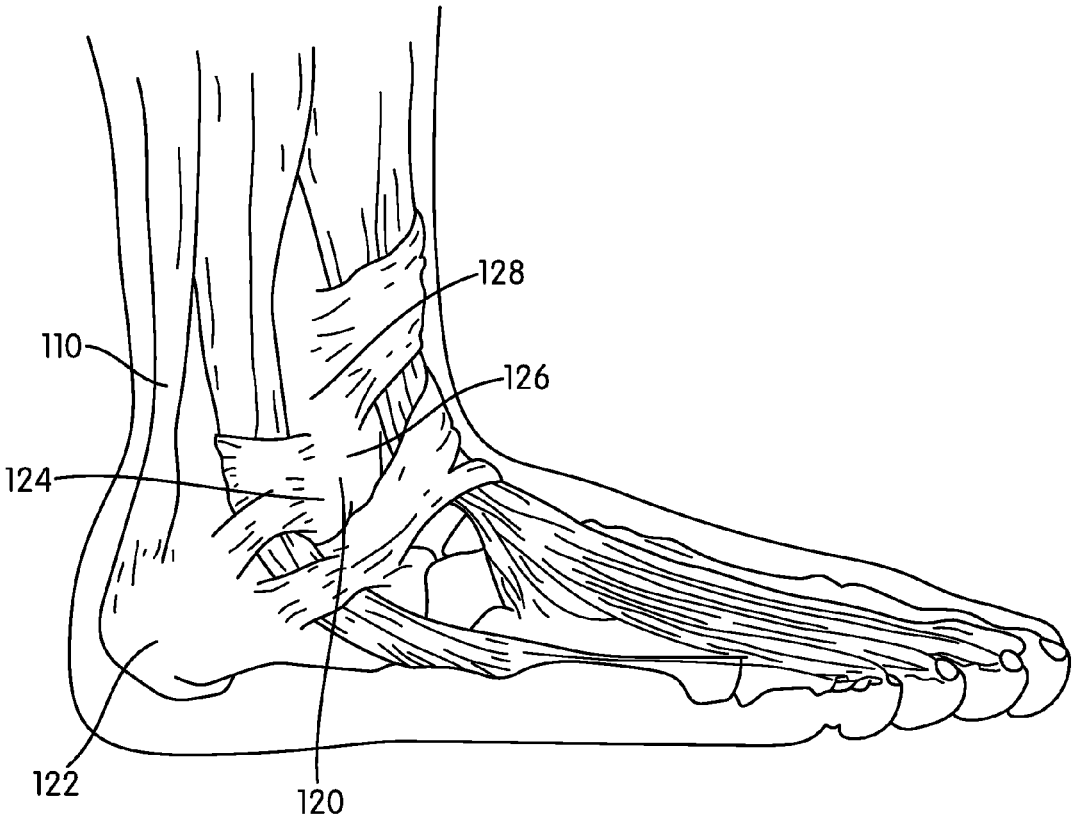
FIG. 9 is a lateral side elevational view of a foot of a wearer.
Figure 10:
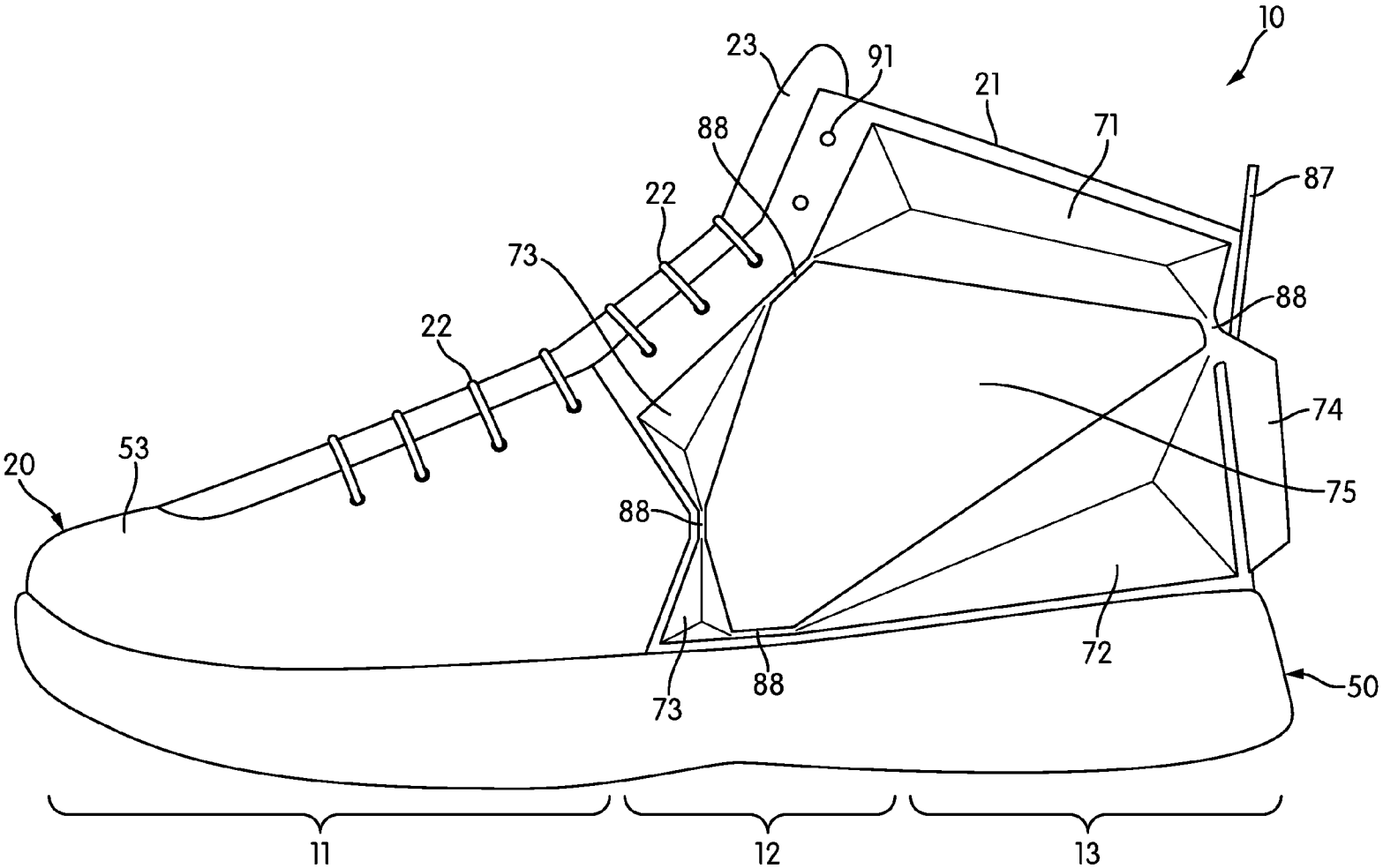
FIG. 10 is a lateral side elevational view of a second embodiment of the article of footwear having an upper incorporating a chamber element.
Figure 11:
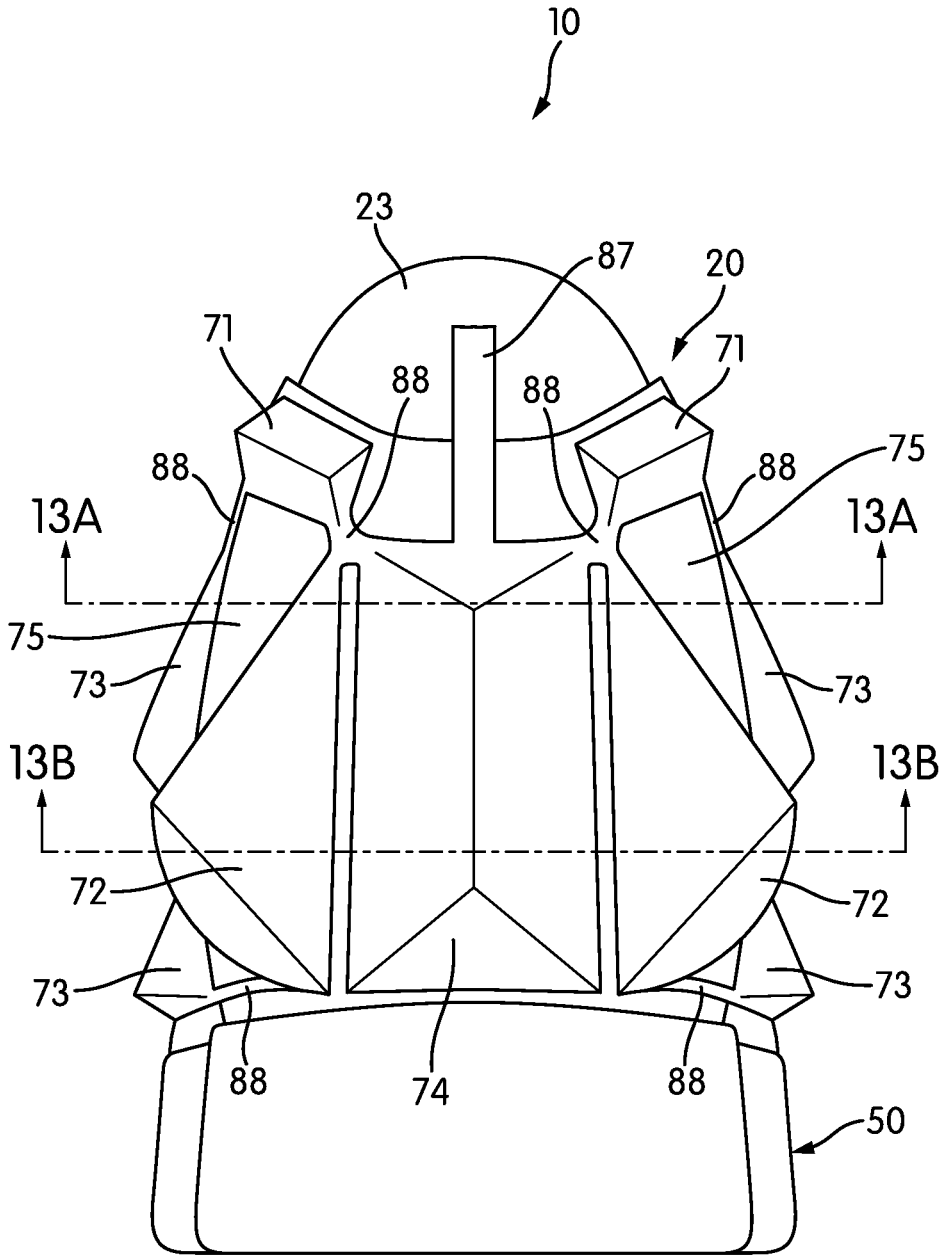
FIG. 11 is a rear elevational view of the article of footwear of FIG. 10.
Figure 12:
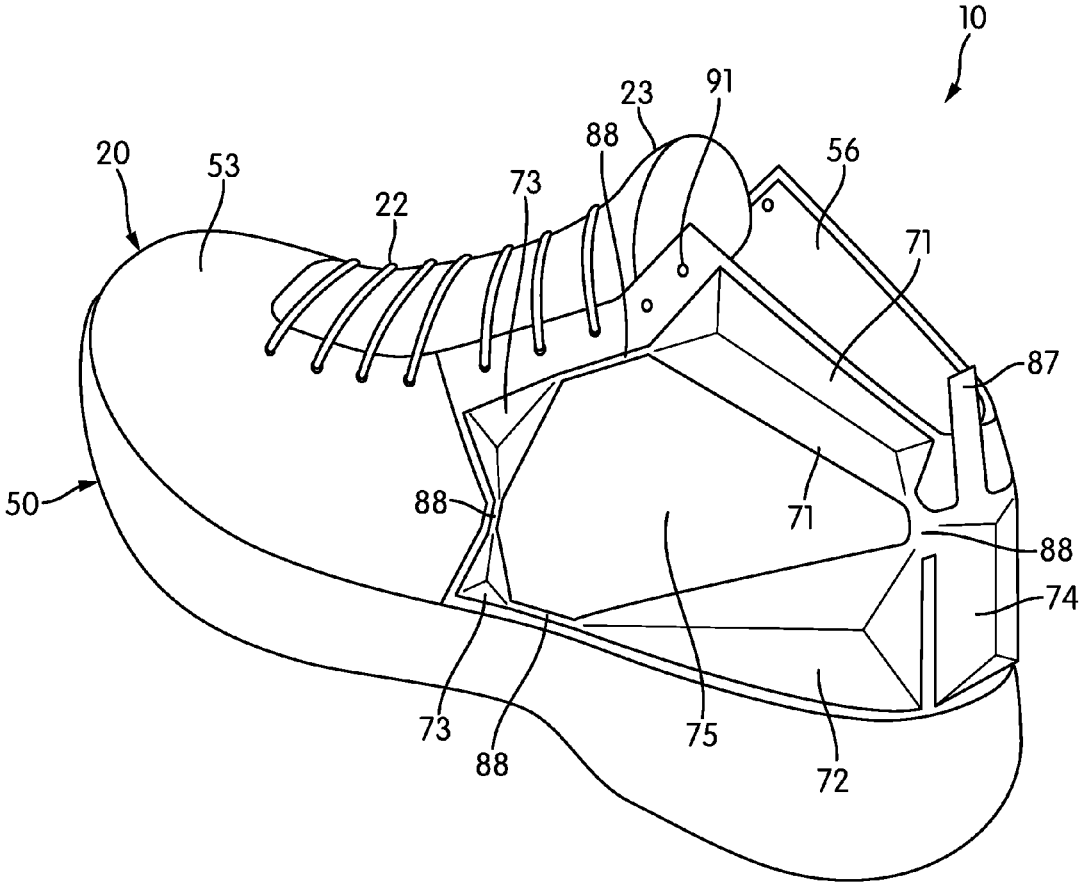
FIG. 12 is a perspective view of the article of footwear of FIG. 10.
Figure 13A:
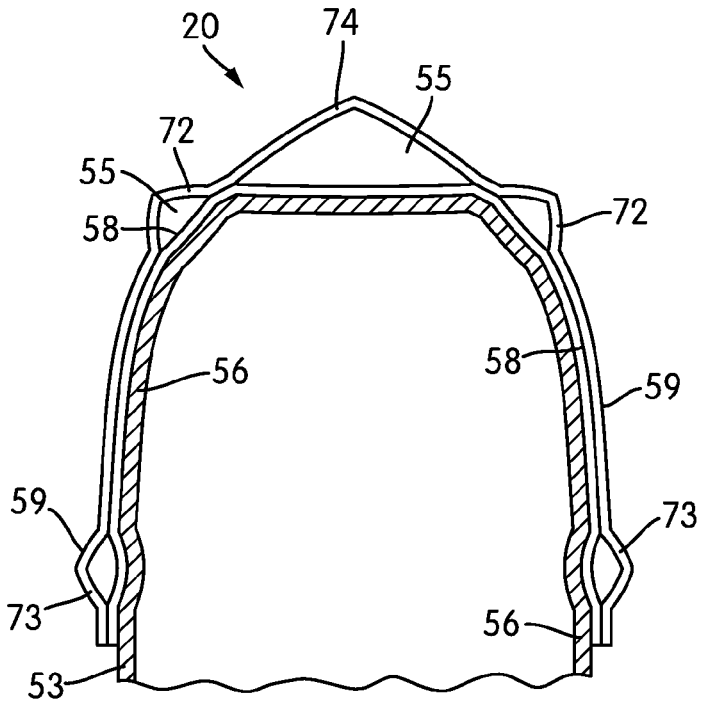
FIGS. 13A-13B are cross-sectional views of the article of footwear of FIG. 10, as defined by section lines 13A and 13B in FIG. 11.
Figure 13B:
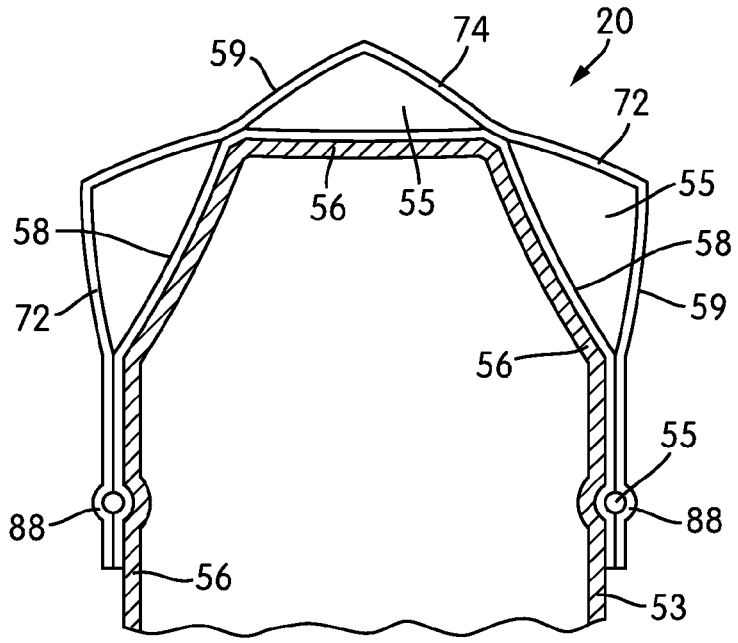
Figure 14:
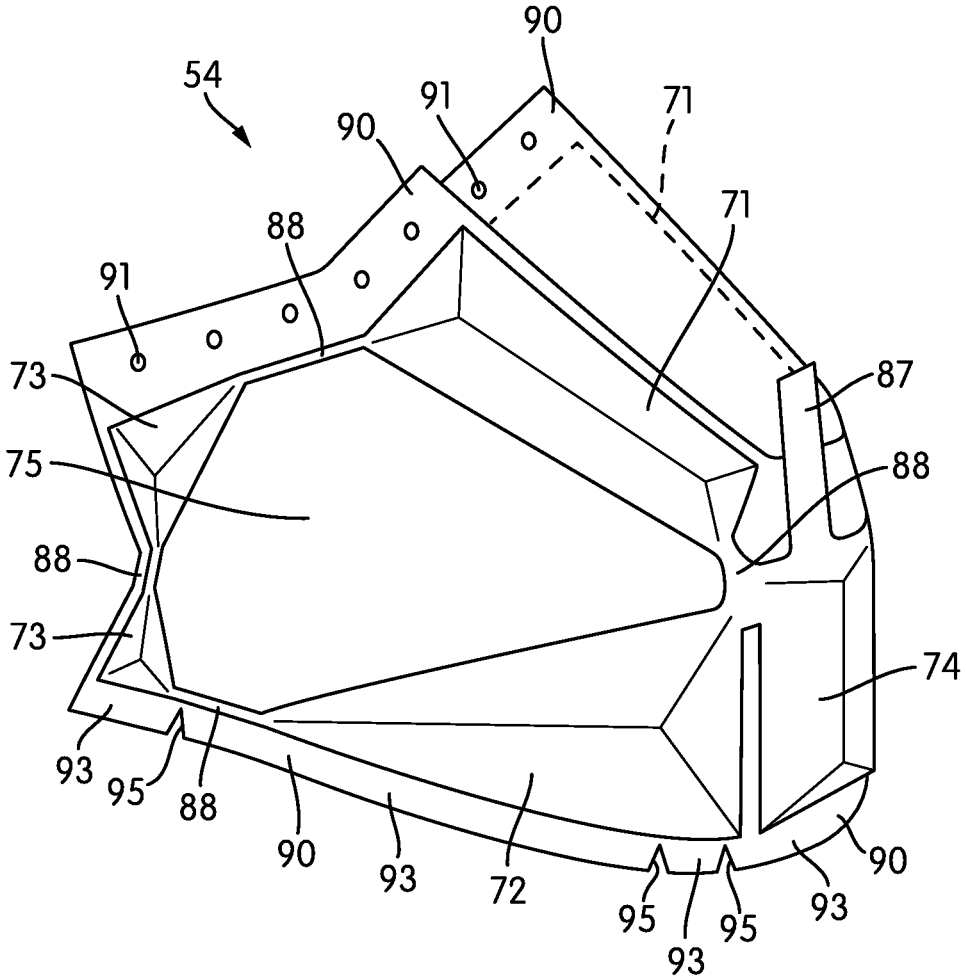
FIG. 14 is a perspective view of the chamber element of FIG. 10.
Figure 15:
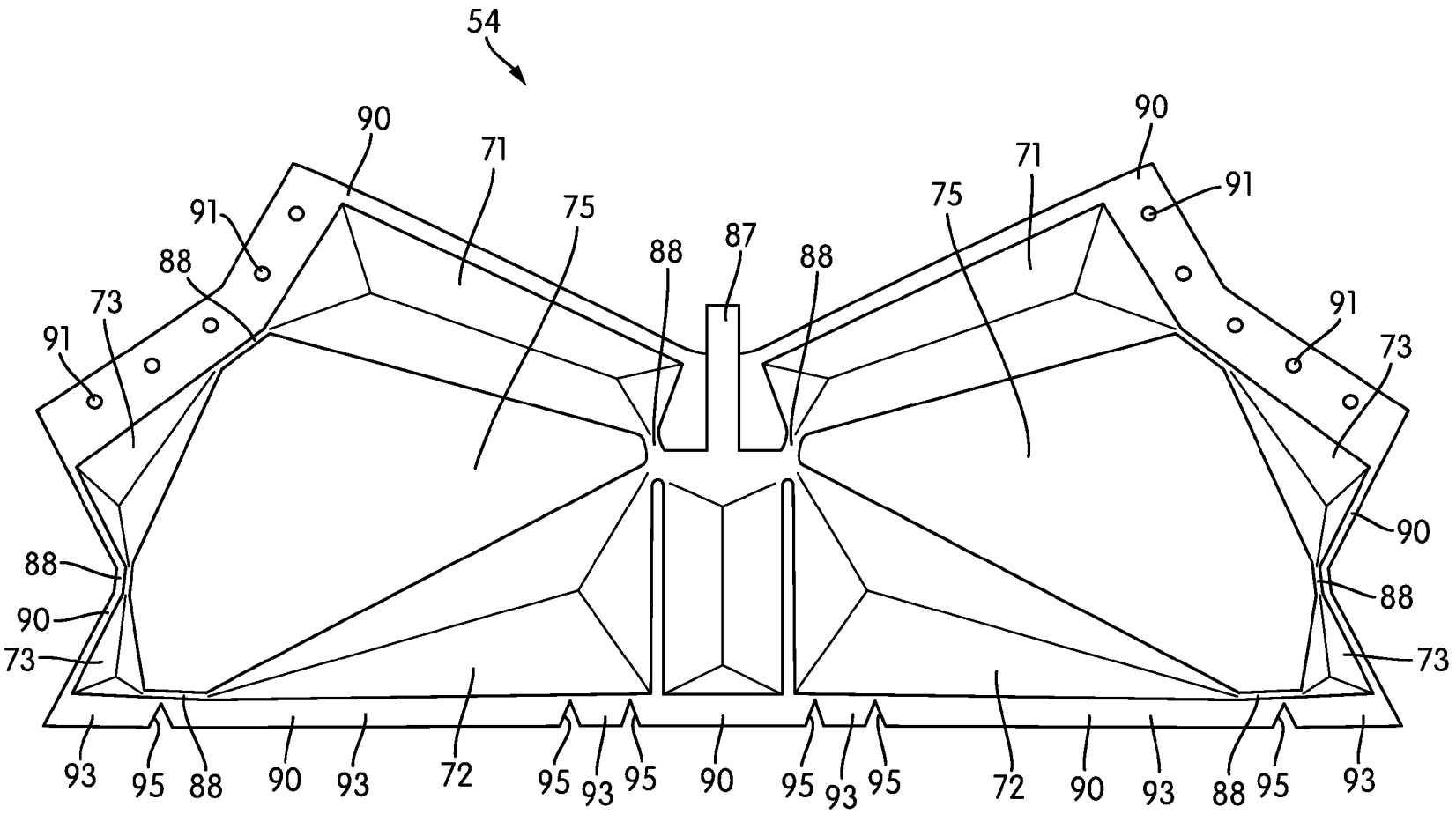
FIG. 15 is a top plan view of the chamber element of FIG. 10.
Figure 16:
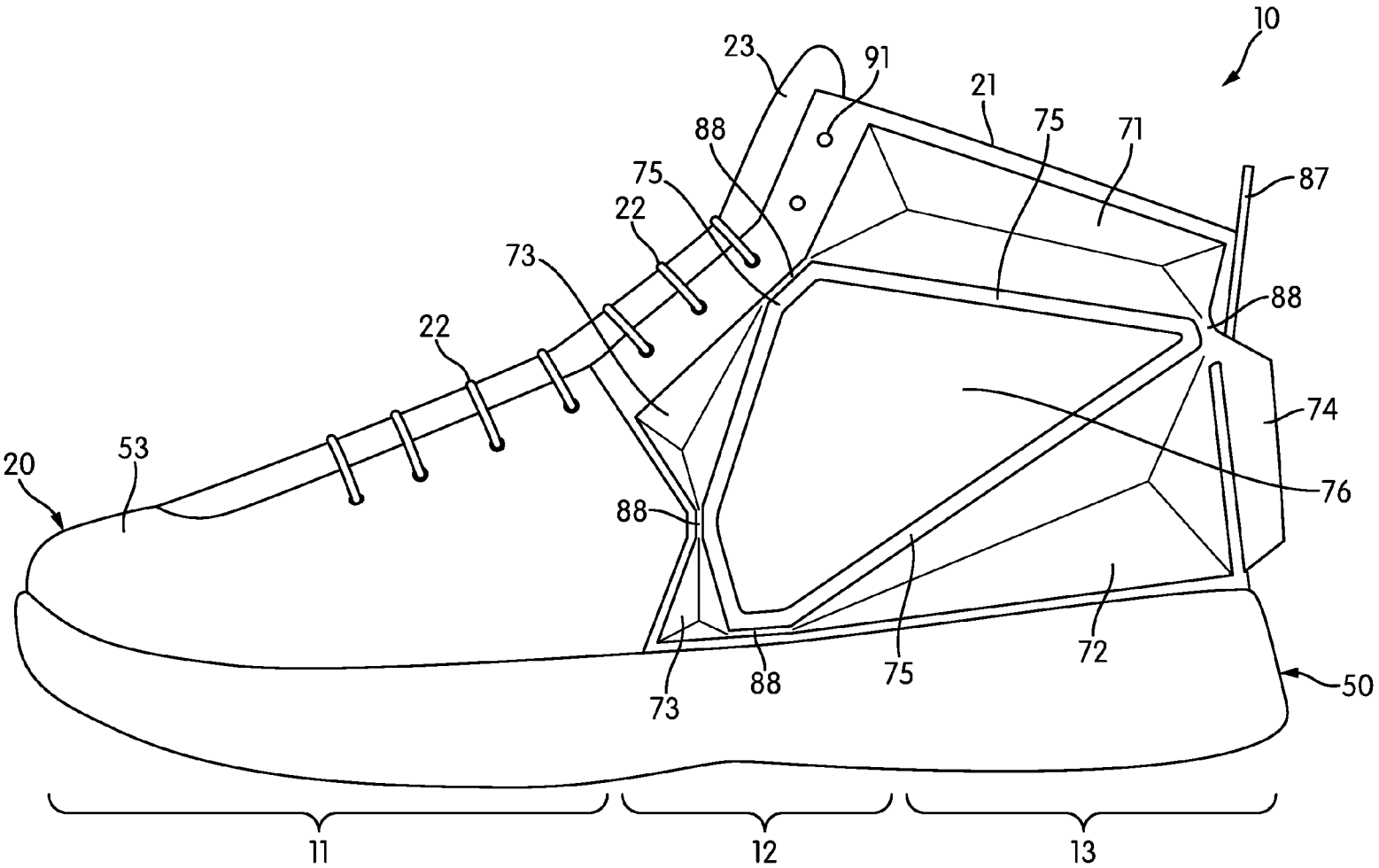
FIG. 16 is a lateral side elevational view of a third embodiment of the article of footwear having an upper incorporating a chamber element.
Figure 17:
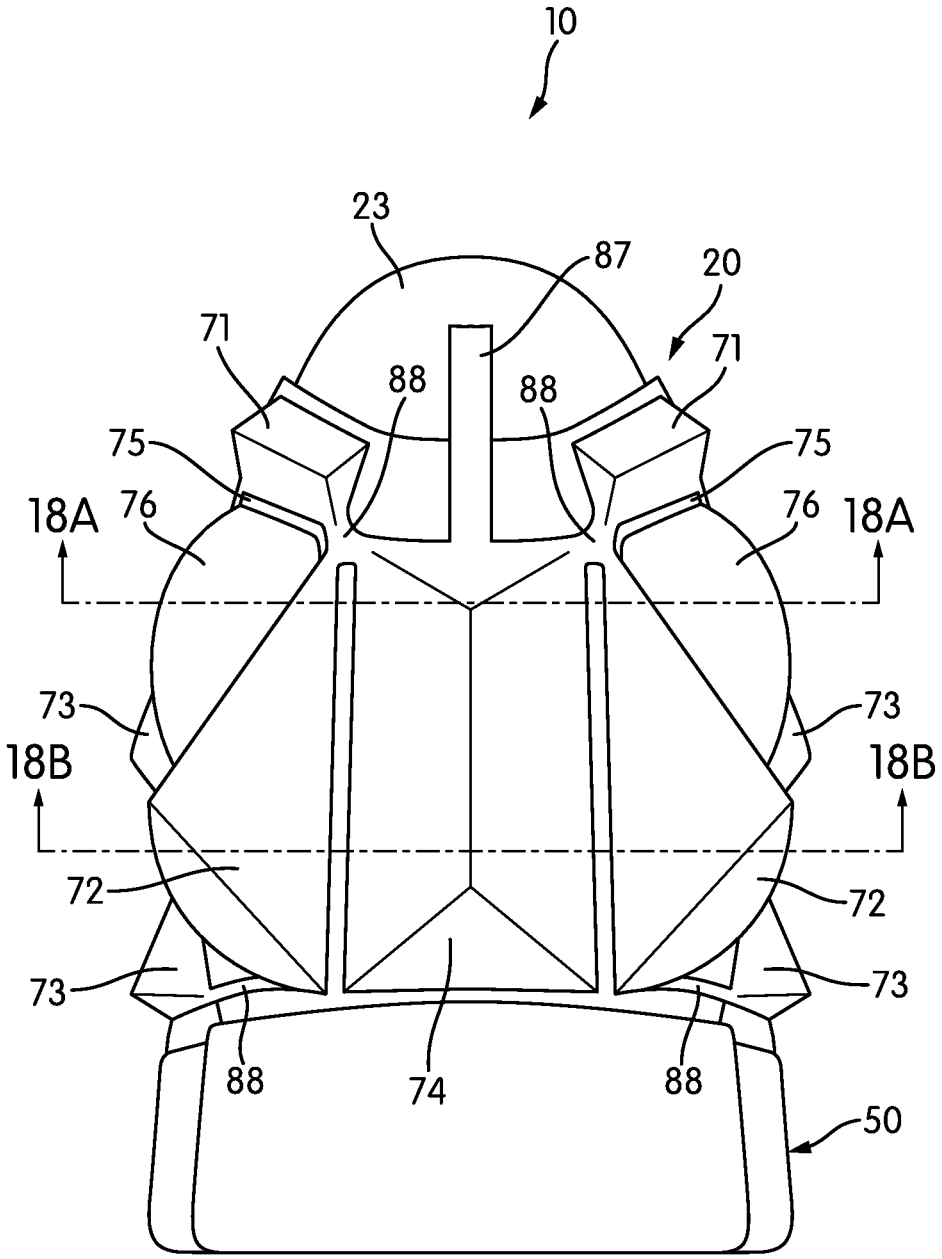
FIG. 17 is a rear elevational view of the article of footwear of FIG. 16.
Figure 18A:
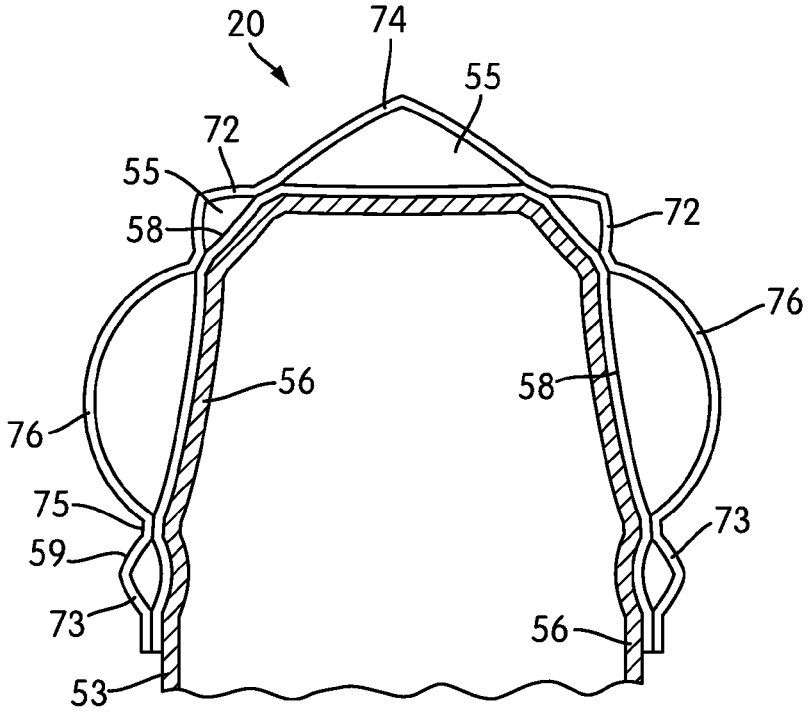
FIG. 18A-18B are cross-sectional views of the article of footwear of FIG. 16, as defined by section lines 18A and 18B in FIG. 17.
Figure 18B:
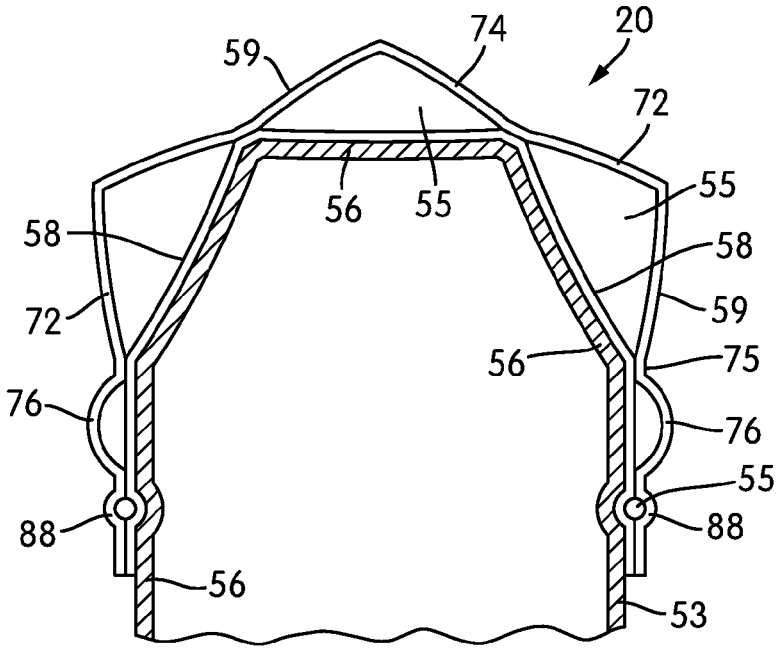
Figure 19:
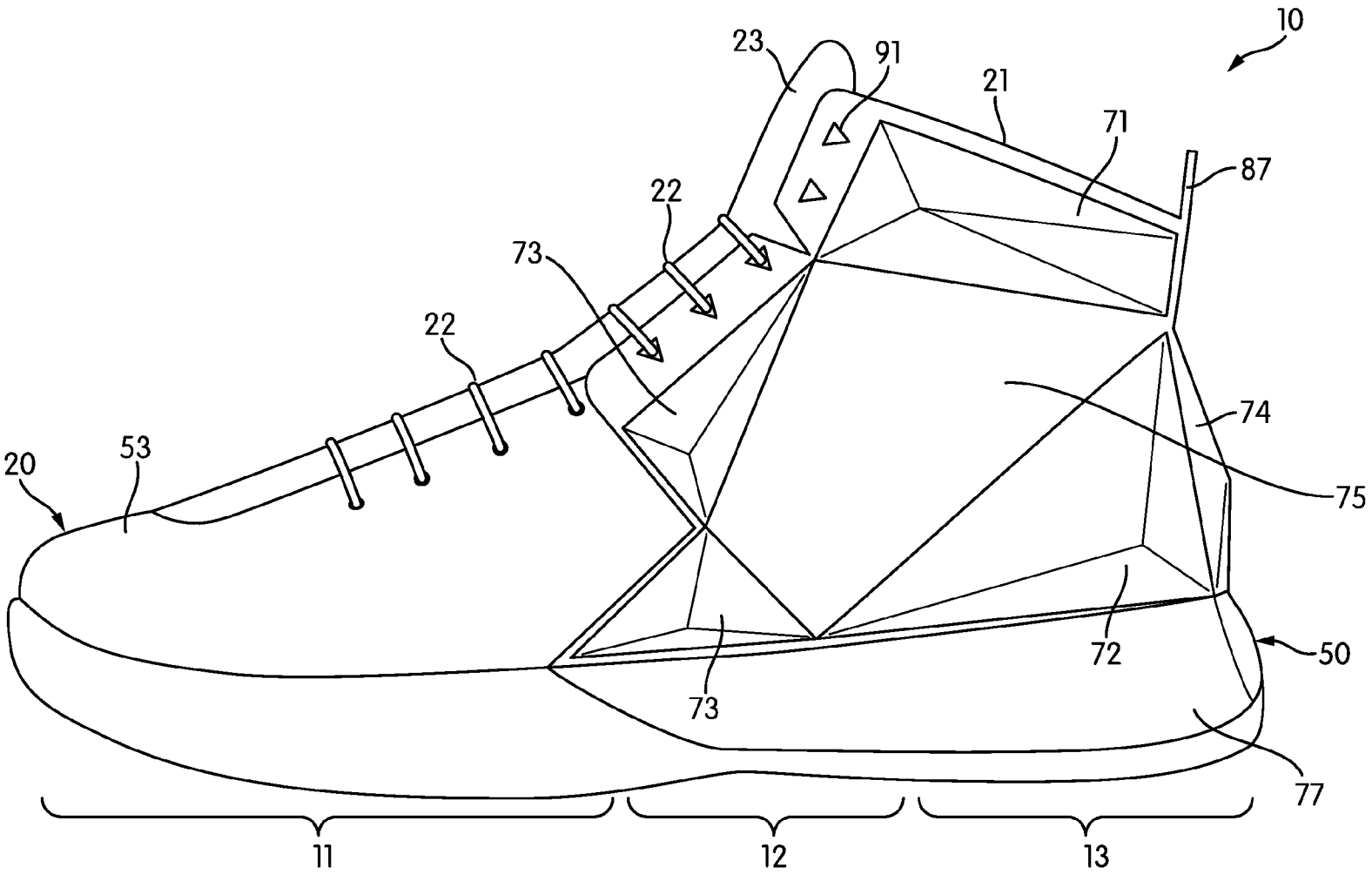
FIG. 19 is a lateral side elevational view of a fourth embodiment of the article of footwear having an upper incorporating a chamber element.
Figure 20:
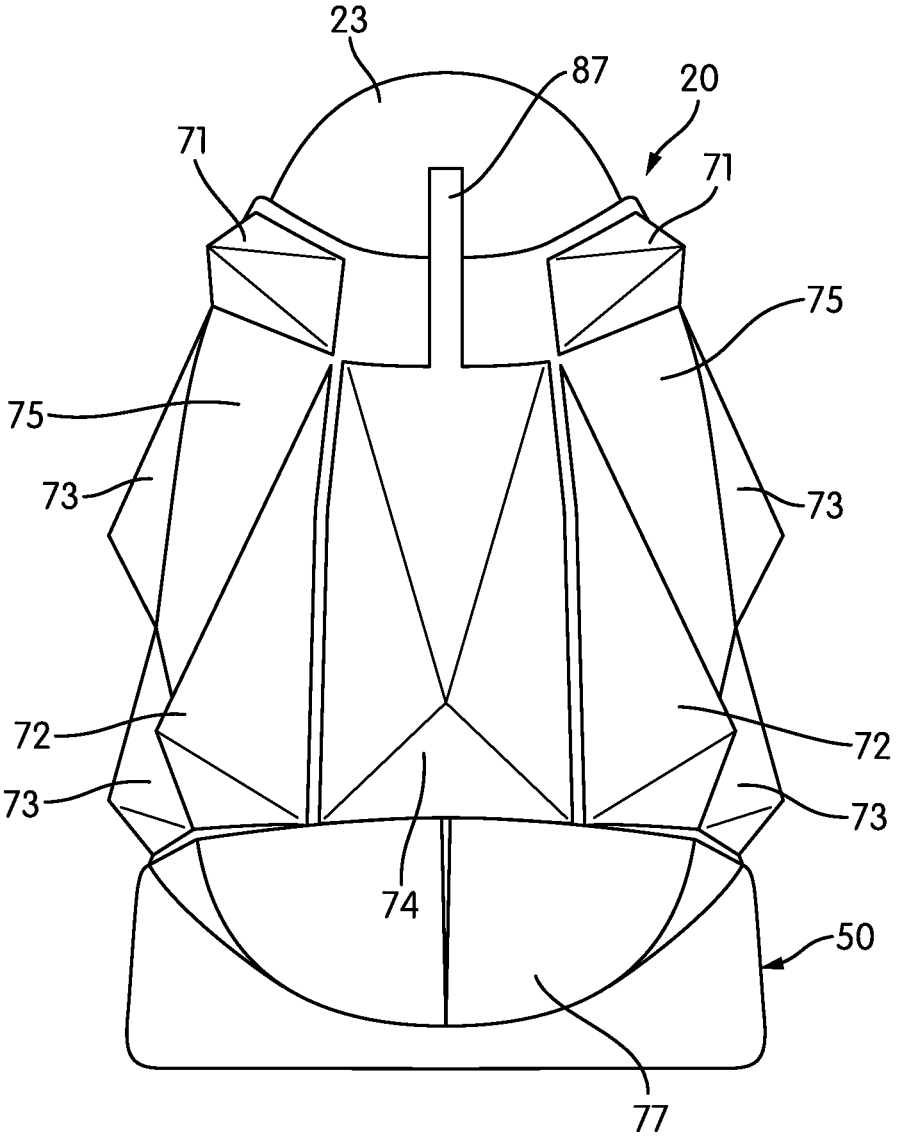
FIG. 20 is a rear elevational view of the article of footwear of FIG. 19.
Figure 21:
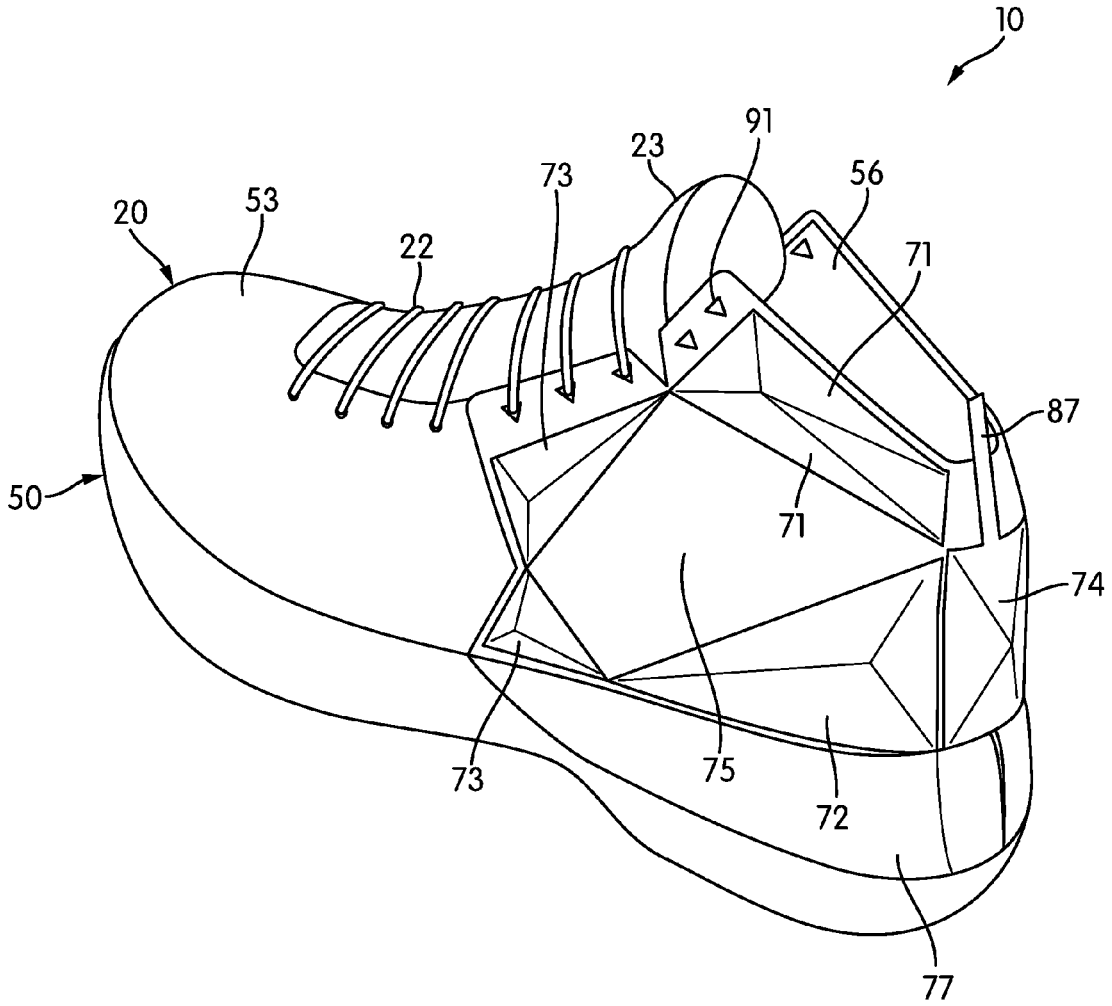
FIG. 21 is a perspective view of the article of footwear of FIG. 19.
Figure 22:
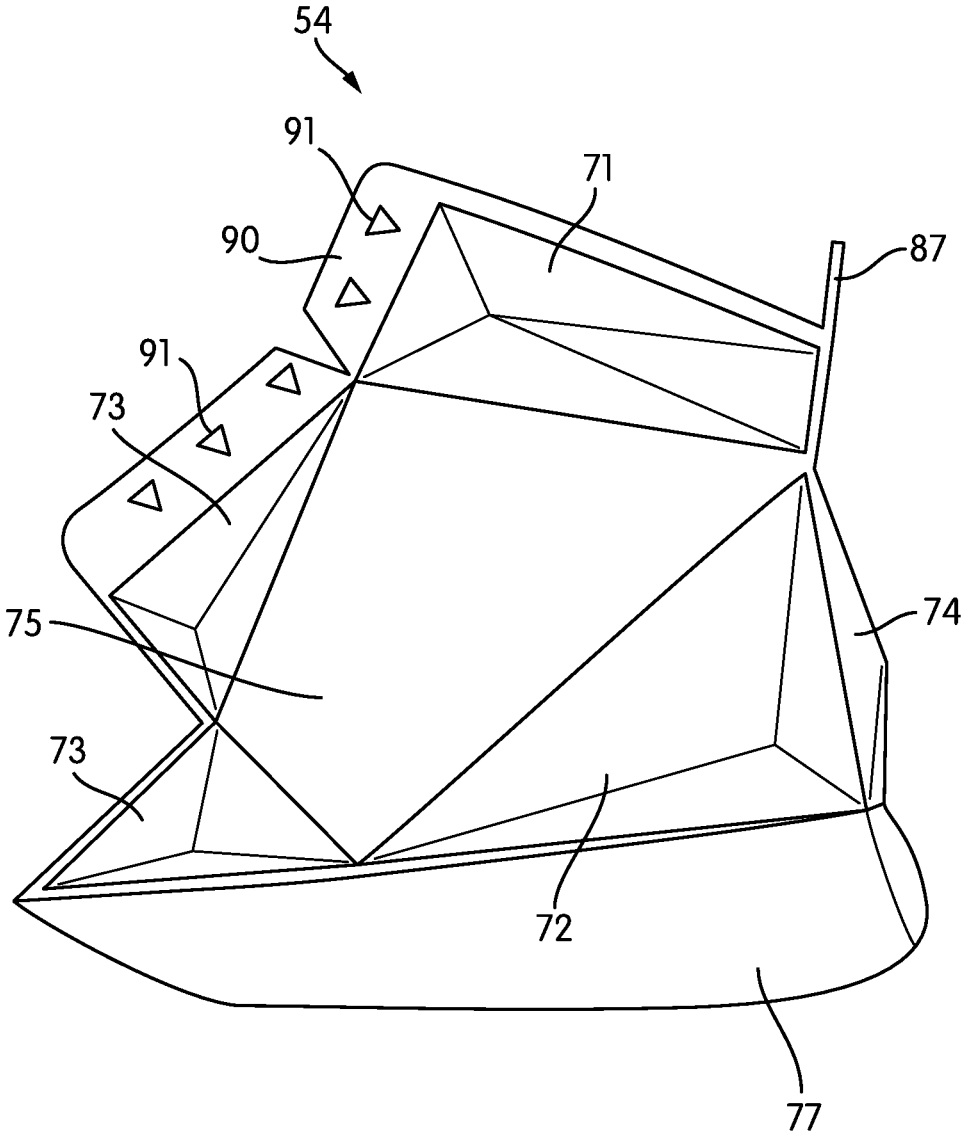
FIG. 22 is a side elevational view of the chamber element of FIG. 19.
Figure 23:
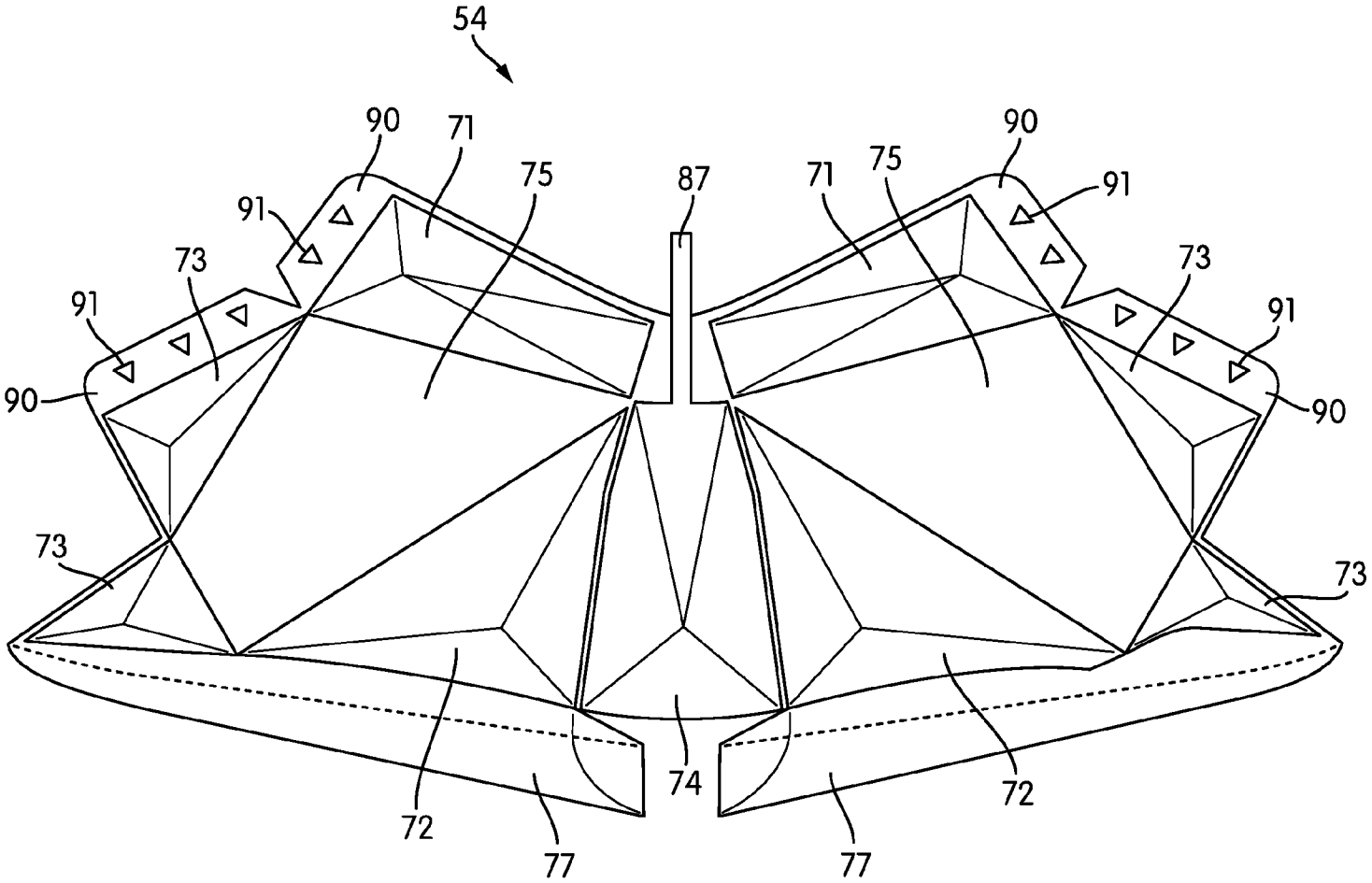
FIG. 23 is a top plan view of the chamber element of FIG. 19.

When upper 20 receives the foot, chamber element 24 may extend around an ankle area of the foot. More particularly, with reference to FIG. 9, chamber element 24 may extend around an Achilles tendon area 110 of the foot. Chamber element 24 may also extend around portions of a tarsus area 120 of the foot, more particularly a calcaneus bone area 122, a talus area 124, a distal tibia area 126, and a distal fibula area 128. As a result, chamber element 24 may extend around portions of the foot corresponding with various joints of the ankle, such as the talocrural joint (between the tibia, the fibula, and the talus), the subtalar joint (between the talus and the calcaneus bone), and the distal or inferior tibiofibular joint (between the distal ends of the tibia and the fibula). Chamber element 24 may similarly extend around portions of the foot corresponding with various ligaments of the ankle, such as the deltoid ligament, the anterior talofibular ligament, the posterior talofibular ligament, and the calcaneofibular ligament.

Figure 5A:
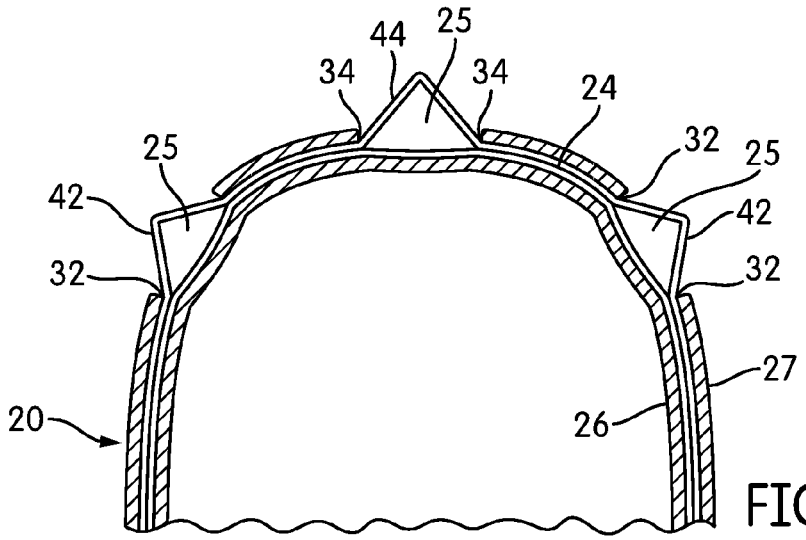
FIGS. 5A-5C are cross-sectional views of the article of footwear, as defined by section lines 5A through 5C in FIG. 3.
Figure 5B:
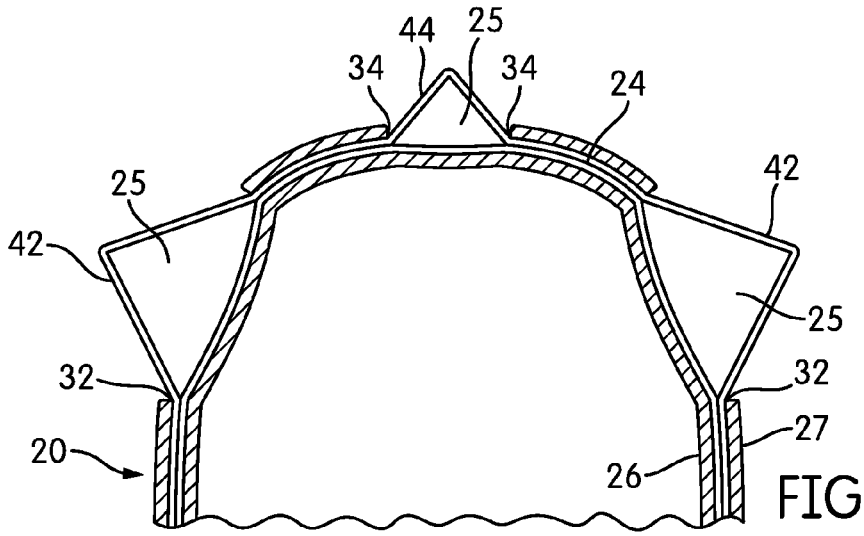
Figure 5C:
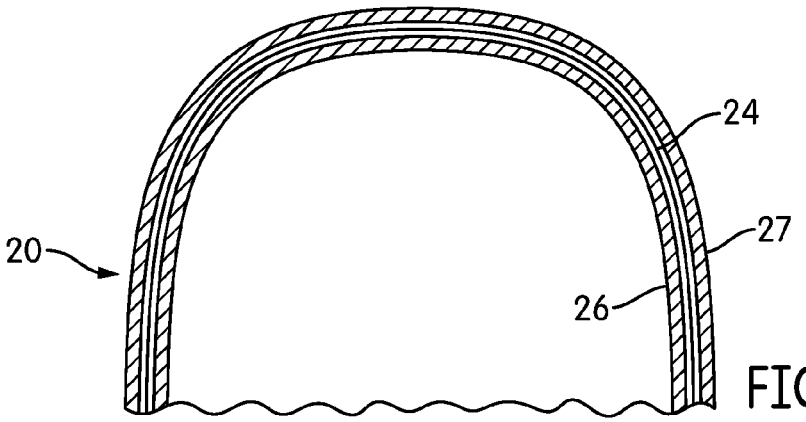

Upper 20 is depicted in FIGS. 5A-5C as having an inner layer 26 and an opposite outer layer 27. Inner layer 26 is positioned adjacent the interior void and forms part of an interior surface of footwear 10, while outer layer 27 forms part of an exterior surface of footwear 10. Each of layers 26 and 27 incorporates one or more material elements (e.g. textiles, leather, synthetic leather, and foam materials) that are stitched, adhered, bonded, or otherwise joined together or attached.

Chamber element 24 is situated between inner layer 26 and outer layer 27. Chamber element 24 is, accordingly, positioned to contact and be flush against inner surfaces of layers 26 and 27 in a sandwich configuration. However, portions of chamber element 24 may be exposed through outer layer 27 to an exterior of footwear 10.

More particularly, outer layer 27 includes a plurality of apertures through which portions of chamber element 24 are exposed. A rear aperture 34 is positioned at a rearward-facing portion of heel region 13, or in a rearfoot region of footwear 10. Additionally, a plurality of laterally-facing apertures are positioned on a lateral side of outer layer 27, while a corresponding plurality of medially-facing apertures are positioned on a medial side of outer layer 27, opposite the laterally-facing apertures. Specifically, both lateral side 14 and medial side 15 include a top aperture 31, a bottom aperture 32, and two front apertures 33. Of these apertures, front apertures 33 are substantially located in midfoot region 12, while rear aperture 34, top apertures 31, and bottom apertures 32 are substantially located in heel region 13.

As depicted, various portions of chamber element 24 are exposed through apertures 31-34. In some alternate configurations, however, portions of chamber element 24 may be exposed to an interior of footwear 10, or may be otherwise not covered by inner layer 26. Nevertheless, while some portions of chamber element 24 may be exposed to an exterior of footwear 10, or to an interior of footwear 10, or both, other portions of chamber element 24 are at least partially positioned between inner layer 26 and outer layer 27 of upper 20.

Figure 6:
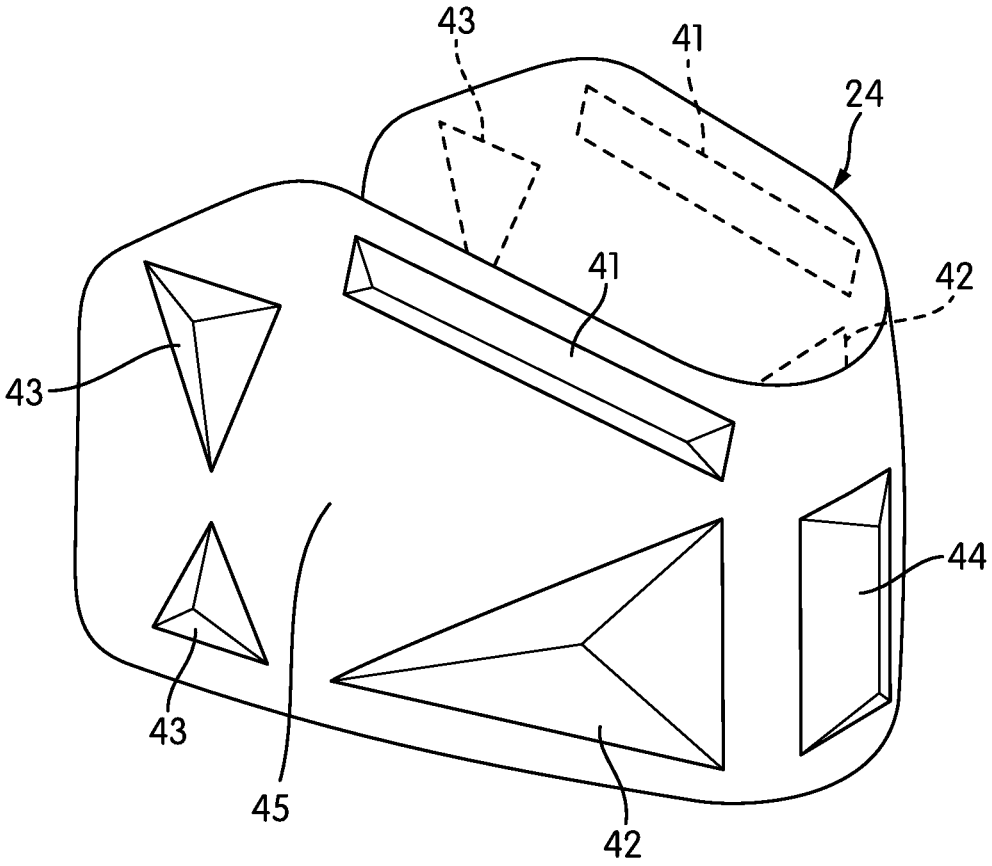
FIG. 6 is a perspective view of the chamber element.
Figure 7:
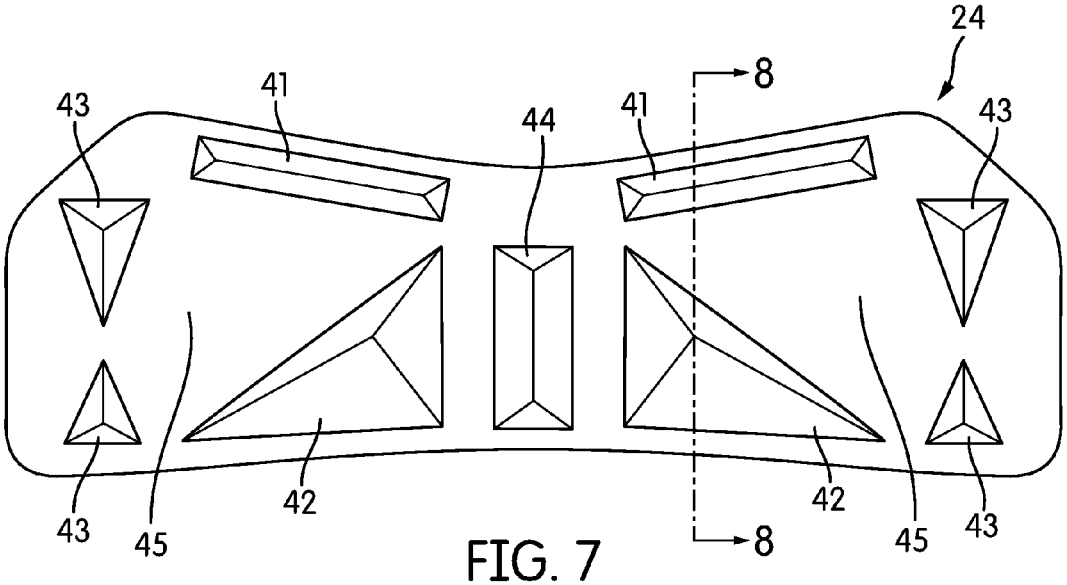
FIG. 7 is a top plan view of the chamber element.
Figure 8:
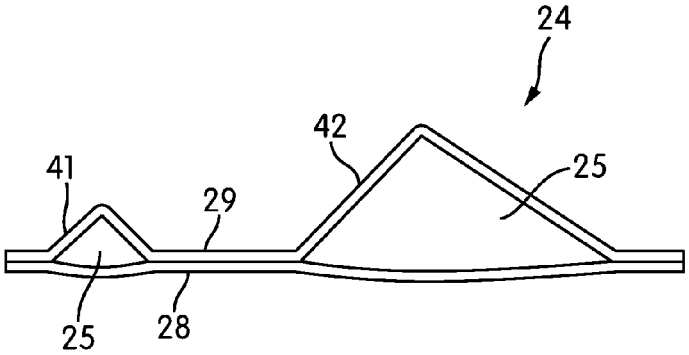
FIG. 8 is a cross-sectional view of the chamber element, as defined by section line 8 in FIG. 7.

As depicted individually in FIGS. 6-8, chamber element 24 is formed from a first barrier layer 28 and an opposite second barrier layer 29. Each of barrier layers 28 and 29 is in turn formed from a polymer material. Barrier layers 28 and 29 define a plurality of subchambers in chamber element 24 and provide a durable sealed barrier for retaining a pressurized fluid 25 within the subchambers. More particularly, chamber element 24 includes a rear subchamber 44, and also includes a top subchamber 41, a bottom subchamber 42, and a front subchamber 43 on both lateral side 14 and medial side 15. Accordingly, subchamber 44 is a heel subchamber, while subchambers 42-44 on lateral side 14 are lateral subchambers and subchambers 42-44 on medial side 15 are medial subchambers.

An interior bond 45 is also defined on both lateral side 14 and medial side 15 of chamber element 24, positioned between subchambers 41-44, and adjacent to interior peripheries or inner peripheries of a plurality of subchambers 41-44. As depicted, subchambers 41-44 on each side are adjacent to at least fifty percent of a periphery of the corresponding interior bond 45. Each interior bond extends across at least twenty percent of an area of chamber element 24, at least fifty percent of a height of chamber element 24, and at least twenty-five percent of a width of chamber element 24.

In various other configurations, subchambers 41-44 may be adjacent to more of a periphery of interior bond 45. For example, subchambers 41-44 may be adjacent to between fifty and eighty percent of a periphery of interior bond 45. Similarly, in various configurations, interior bonds 45 may extend across more of chamber element 24, such as between twenty and thirty percent of an area of chamber element 24, or between fifty and eighty percent of a height of chamber element 24, or between twenty-five and forty percent of a width of chamber element 24.

Accordingly, outer layer 27 defines a plurality of apertures, and chamber element 24 defines a plurality of corresponding subchambers. Returning to FIGS. 1-5C, subchambers 41-44 of chamber element 24 protrude at least partially through apertures 31-34 of outer layer 27, respectively. Portions of subchambers 41-44 thus form parts of an exterior surface of footwear 10.

Furthermore, due to the position of chamber element 24 in upper 20, subchambers 41-44 protrude through apertures 31-34 in various directions, as depicted in FIGS. 1-5C. Subchamber 44, for example, is positioned at a rearward-facing portion of heel region 13 and protrudes in a rearward direction through aperture 34 of outer layer 27. In a similar manner, subchambers 41-43 positioned on lateral side 14 protrude outward in a lateral direction through corresponding apertures 31-33 on lateral side 14, while subchambers 41-43 positioned on medial side 15 protrude outward in a medial direction through corresponding apertures 31-33 on medial side 15.

Subchambers 41-44 are formed in various positions on chamber element 24. Rear subchamber 44, top subchambers 41, and bottom subchambers 42 are substantially located in heel region 13, while front subchambers 43 are substantially located in midfoot region 12. Rear subchamber 44 and top subchambers 41 are formed to have elongate rectangular configurations, while bottom subchambers 42 and front subchambers 43 are formed to have triangular configurations.

Subchambers 41-44 are thus formed and shaped, and are positioned in various areas of footwear 10, to correspond with various areas of the foot. Rear subchamber 44 is positioned to the rear of an area of footwear 10 extending around Achilles tendon area 110 of the foot, while portions of subchambers 42 are positioned in areas of footwear 10 extending around lateral and medial sides of Achilles tendon area 110 of the foot. Similarly, top subchambers 41 are positioned in areas of footwear 10 near the talus of the foot (i.e., the uppermost tarsal bone) and the distal ends of the tibia and the fibula; front subchambers 43 are positioned in areas of footwear 10 near anterior portions (i.e., front portions) of the talus and the calcaneus; and portions of subchambers 42 are positioned in areas of footwear 10 near posterior portions (i.e., back portions) of the talus and the calcaneus. That is, subchambers 41-43 are positioned on lateral and medial sides of tarsus area 120 of the foot.

An advantage of subchambers 41-44, and of interior bonds 45 positioned between subchambers 41-44, is that a stability of footwear 10 may be increased in positions corresponding with various areas of the foot, such as (a) around the Achilles tendon and (b) around the bones, joints, and ligaments of the ankle. At the same time, subchambers 41-44 may enhance a cushioning of footwear 10, and may also enhance a fit of an interior surface of footwear 10 against the foot of a wearer. That is, subchambers 41-44 and interior bonds 45 may make chamber element 24 more resistant to deforming or stressing forces, which may in turn improve the stability of footwear 10, while subchambers 41-44 may also improve the cushioning of footwear 10 and its capacity to conform to a wearer's foot.

In manufacturing chamber element 24, a pair of polymer sheets may be molded during a thermoforming process to define barrier layers 28 and 29. The thermoforming process may impart differing thicknesses to barrier layers 28 and 29 in different areas of chamber element 24. For example, barrier layer 28 or barrier layer 29 may have a first thickness at interior bonds 45, or at other areas of chamber element 24 where the two barrier layers are bonded together, and a second, lesser thickness at one of subchambers 41-44. Accordingly, barrier layers 28 and 29 may be thinner at subchambers 41-44 than at interior bond 45.

As depicted, barrier layers 28 and 29 are formed from a transparent colored polymer material, through which light may pass without being scattered. Barrier layers 28 and 29 are, therefore, colored and see-through. In some configurations, however, barrier layers 28 and 29 may be formed from a non-transparent colored material. For example, barrier layers 28 and 29 may be formed from a translucent colored material, through which light may pass while being scattered, or an opaque colored material, through which light may not pass.

Moreover, in some configurations, one layer of barrier layers 28 and 29 may be formed from a colored polymer material, while the other layer is formed from a non-colored polymer material. For example, first barrier layer 28 may be made of a transparent colored polymer material, and second barrier layer 29 may be made of a non-colored polymer material (which may be transparent, translucent, or opaque). Alternatively, first barrier layer 28 may be made of a transparent polymer material that is not colored, while second barrier layer 29 may be made of a colored polymer material. Accordingly, when such configurations of chamber element 24 are incorporated into footwear 10, second barrier layer 29 may be seen through the transparent material of first barrier layer 28, and may thereby be exposed through both first barrier layer 28 and various apertures in outer layer 27.

Some configurations of chamber element 24 may incorporate more than one colored material. As one example, each of barrier layers 28 and 29 may be formed of a different colored polymer material (one red and one blue, for example). In other configurations, either or both of barrier layers 28 and 29 may be formed from a material having multiple colors, or from multiple materials each having a color. Some configurations may incorporate a material having multiple colors in a pattern, or multiple colors comprising a graphical element or indicia.

In other configurations, a transparent colored material may be incorporated into one or more of barrier layers 28 and 29, but either the color of the material, or the transparency of the material, or both may extend only throughout a portion of barrier layers 28 and 29. For example, second barrier layer 29 may be partially formed from a transparent colored material, so that a corresponding portion of second barrier layer 29 subsequently exposed through an aperture in outer layer 27 of footwear 10 is transparent and colored, while other portions may be non-transparent or non-colored. Barrier layers 28 and 29, and subchambers 41-44, may accordingly be at least partially formed from a colored polymer material By incorporating materials having one or more colors into chamber element 24, and by incorporating one or more apertures into outer layer 27, footwear 10 may advantageously facilitate the identification of a wearer. In various configurations, if at least one of barrier layers 28 and 29 incorporates a color, an on-looking viewer may be able to see and interpret that color—and, in turn, footwear 10—as being associated with a particular individual, for example, or as being associated with a particular team or organization. Moreover, since portions of subchambers 41-44 protruding through apertures 31-34 may be seen even from highly oblique angles, a colored polymer material of subchambers 41-44 may assist an on-looking viewer in identifying footwear 10 as being associated with an individual or team even when subchambers 41-44 are viewed at highly oblique angles, such as from a position in front of or behind footwear 10. The incorporation of colored polymer materials into chamber element 24 may accordingly help to identify or otherwise differentiate an individual wearing footwear 10. Enabling different color combinations, along with the possibility of varying the shapes, sizes and positions of apertures in outer layer 27, provides much more design freedom for aesthetics as well as identifying symbols and colors.

The thermoforming process used to mold the pair of polymer sheets and define barrier layers 28 and 29 serves to (a) impart shape to portions of the polymer sheets to define subchambers 41-44 of chamber element 24 and (b) form bonded portions of chamber element 24 around and between subchambers 41-44. These bonded portions include a portion extending around a periphery of chamber element 24, as well as interior bonds 45 on each side of chamber element 24.

In some configurations, an inflation conduit leading to one or more of subchambers 41-44 may be formed in chamber element 24, as well as one or more internal conduits, and subchambers 41-44 may be in fluid communication with each other through the internal conduits. However, in other configurations, subchambers 41-44 may not be in fluid communication with each other, and may be separately pressurized or inflated. Following the thermoforming process, a fluid 25 such as air or nitrogen may be injected into through the inflation conduit, and from there into the internal conduits and subchambers 41-44. Fluid 25 may then be pressurized to between zero and three-hundred-fifty kilopascals (i.e., approximately fifty-one pounds per square inch) or more, and the polymer sheets may be bonded or joined together to form a seal that prevents fluid 25 from escaping. In various configurations, a thermoforming process or other process may accordingly be used to bond portions of barrier layers 28 and 29 together, and seal barrier layers 28 and 29 to enclose fluid 25 in subchambers 41-44.

A wide range of polymer materials may be utilized for layers 28 and 29. In selecting a material for layers 28 and 29, engineering properties of the material (e.g., tensile strength, stretch properties, fatigue characteristics, dynamic modulus, and loss tangent) as well as the ability of the material to prevent the diffusion of the fluid contained by layers 28 and 29 may be considered. When formed of thermoplastic urethane, for example, layers 28 and 29 may have a thickness of approximately 1.0 millimeter, but the thickness may range from 0.25 to 2.0 millimeters or more, for example. In addition to thermoplastic urethane, examples of polymer materials that may be suitable for chamber 33 include polyurethane, polyester, polyester polyurethane, and polyether polyurethane. Layers 28 and 29 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al, the entire disclosures of which are hereby incorporated by reference. A variation upon this material may also be utilized, wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for layers 28 and 29 is a flexible microlayer membrane that includes alternating layers of a gas barrier material and an elastomeric material, as disclosed in U.S. Pat. Nos. 6,082,025 and 6,127,026 to Bonk, et al. Further suitable materials include polyurethane including a polyester polyol, as disclosed in U.S. Pat. Nos. 6,013,340, 6,203,868, and 6,321,465 to Bonk, et al, the entire disclosures of which are hereby incorporated by reference.

In some configurations of footwear 10, fluid 25 may be any of a variety of fluids, such as a gas, a liquid such as water, a gel material, or another non-gaseous fluid. With regard to gasses, chamber element 24 (and subchambers 41-44) may enclose air, nitrogen, octafluorapropane, hexafluoroethane, or sulfur hexafluoride, for example. Fluid 25 may also be a colored substance, such as a colored liquid, or a colored gel material, or a colored gas. Meanwhile, barrier layers 28 and 29 may be formed of a transparent, non-colored polymer material, while fluid 25 of footwear 10 may be a colored liquid or a colored gel. Fluid 25 may accordingly be exposed seen through the transparent material of first barrier layer 28, and may thereby be exposed through both first barrier layer 28 and various apertures in outer layer 27.

Although chamber element 24 is discussed above and depicted as being sealed, in some configurations, chamber element 24 may be a component of a fluid system within footwear 10. For example, pumps, conduits, and valves may be joined with chamber element 24 to provide a fluid system that pressurizes chamber element 24 with air from the exterior of footwear 10. More particularly, chamber element 24 may be utilized in combination with any of the fluid systems disclosed in U.S. Pat. No. 7,210,249 to Passke, et al. and U.S. Pat. No. 7,409,779 to Dojan, et al.

Second Upper and Chamber Element Configuration

FIGS. 10-15 depict a second configuration footwear 10 and an upper and chamber element incorporated therein. As depicted, footwear 10 includes upper 20 defining an interior void for receiving a foot of the wearer and sole structure 50 extending between the foot and the ground. Upper 20 in turn includes a material element 56 positioned adjacent to the interior void and a chamber element 54.

Chamber element 54 extends across and is secured to an outer surface of material element 56 in midfoot region 12 and heel region 13 of footwear 10. More particularly, chamber element 54 extends from midfoot region 12 on lateral side 14, around heel region 13, and into midfoot region 12 on medial side 15. Accordingly, a forward portion 53 of material element 56 forms part of an exterior surface of upper 20 in forefoot region 11, while chamber element 54 forms part of the exterior surface of upper 20 in midfoot region 12 and heel region 13. Forward portion 53 is depicted as extending from lateral side 14 to medial side 15 in forefoot region 11. Forward portion 53 of material element 56 may accordingly define the interior void in forefoot region 11, while a rearward portion of material element 56 may define the interior void in midfoot region 12 and heel region 13.

Chamber element 54 includes a first barrier layer 58 and a second barrier layer 59 that define a plurality of subchambers, which are sealed to enclose and retain a pressurized fluid 55. Chamber element 54 is accordingly formed to include a plurality of subchambers extending outward from footwear 10.

In general, chamber element 54 may include any of a variety of configurations of subchambers, such as those described above with respect to FIGS. 1-8. As depicted in FIGS. 10-15, chamber element 54 includes top subchambers 71, bottom subchambers 72, front subchambers 73, and rear subchamber 74. Chamber element 54 is also depicted as defining internal conduits 88, and subchambers 71-74 are in fluid communication with each other through internal conduits 88. In other configurations of chamber element 54, however, one or more internal conduits 88 may be absent, and one or more subchambers 71-74 may be sealed to enclose fluid 55 therein.

Barrier layers 58 and 59 of chamber element 54 are bonded at bonded areas 75, which extend around and between subchambers 71-74 and internal conduits 88. Bonded areas 75 of chamber element 24 thus define the various peripheral shapes of subchambers 71-74 and internal conduits 88.

A peripheral bond 90 extends around an outer periphery of chamber element 54 and, in turn, around subchambers 71-74. Peripheral bond 90 includes a plurality of eyelets 91 adjacent to front subchambers 73. Lace 22 may be threaded through eyelets 91 in addition to other parts of upper 20 adjacent to tongue portion 23. However, some configurations of chamber element 54 may not include eyelets 91.

Peripheral bond 90 also includes a plurality of flaps 93 separated by a plurality of notches 95. Due to the configuration of notches 95 along peripheral bond 90, when chamber element 54 is bent around heel region 13 of footwear 10, flaps 93 may be bent inward and upward without obstructing each other. A lower and outer surface of flaps 93 may then be secured to the midsole of sole structure 50 in the course of incorporating chamber element 54 into upper 20.

As depicted, chamber element 54 also includes an inflation conduit 87. In one exemplary manufacturing process, two polymer sheets may be thermoformed to form barrier layers 58 and 59, which in turn include bonded areas 75, peripheral bond 90, and inflation conduit 87. Bonded areas 75 may define subchambers 71-74, as well as internal conduits 88. Following the thermoforming process, a fluid 55 (which may be a gas, such as air or nitrogen) is injected through inflation conduit 87, and from there into internal conduits 88 and subchambers 71-74. Fluid 55 may then be pressurized to between zero and three-hundred-fifty kilopascals (i.e., approximately fifty-one pounds per square inch) or more, and inflation conduit 87 may be sealed to prevent fluid 55 from escaping. Once sealed, inflation conduit 87 may advantageously serve as a pull-tab, to assist a wearer in donning footwear 10.

On some configurations, one or both of the polymer sheets may also incorporate strands of material. For example, the polymer sheet used to form first barrier layer 58 may incorporate a first set of parallel strands of material running in a first direction and a second set of parallel strands of material running in a second direction. In such configurations, the strands of the first set may be joined to the strands of the second set where they overlap to form a net or a web of material strands. The incorporation of parallel strands of material (or a net or web of material strands) into first barrier layer 58 may advantageously restrict an outward expansion of barrier layer 58 upon pressurization of chamber element 54.

As depicted, chamber element 54 surrounds a rearfoot region of footwear 10, extending from lateral side 14 to medial side 15 and around heel region 13, and forms at least 95 percent of an exterior surface of upper 20 in both midfoot region 12 and heel region 13. In other configurations, chamber element 54 may form at least 80 percent of an exterior surface of upper 20 in regions 12 and 13. The extent of chamber element 54, and the positioning of subchambers 72-74 on chamber element 54, may advantageously stabilize various portions of footwear 10, such as (a) portions around the Achilles tendon, and (b) portions around the bones, joints, and ligaments of the ankle. Chamber element 54 and subchambers 71-74 may also enhance cushioning properties of upper 20 and of footwear 10, and may enhance a fit of footwear 10 against the foot of a wearer.

Meanwhile, barrier layers 58 and 59 may be formed to include materials similar to those discussed above with respect to FIGS. 1-8. For example, either or both of layers 58 and 59 may be formed from a transparent colored polymer material. Alternatively, chamber element 54, and subchambers 71-74, may be at least partially formed from a colored material, or may include colored portions.

By incorporating one or more colored materials into chamber element 54, footwear 10 may advantageously facilitate the identification of a wearer, either as a particular individual, or as being associated with a particular team or organization. Moreover, by protruding outward from footwear 10, subchambers 71-74 may facilitate the identification of a wearer even when viewed at highly oblique angles (such as when viewed from the front or the rear of the wearer). Meanwhile, material element 56 may also incorporate materials of various colors, including not only white materials, but materials of other colors. One or more colors of material element 56 may thus combine with one or more colors of barrier layers 58 and 59 to generate specific colors and patterns of color as viewed from the exterior of footwear 10.

Chamber element 54 is depicted in FIGS. 10-13B as being positioned adjacent to an outer surface of material element 56 and as forming part of an exterior surface of upper 20 in both midfoot region 12 and heel region 13 of footwear 10. However, other configurations of material element 56 and chamber element 54 are possible.

In some alternate configurations, for example, material element 56 may have both an inner portion and an outer portion, and the outer portion may be substantially absent from portions heel region 13, or from portions of both midfoot region 12 and heel region 13. Accordingly, the outer portion of material element 56 may include an aperture exposing the inner portion of material element 56 in heel region 13, or in both heel region 13 and midfoot region 12. In such configurations, part of peripheral bond 90 may be positioned between the inner portion of material element 56 and the outer portion of material element 56.

In other alternate configurations, material element 56 may be substantially absent from heel region 13, or from heel region 13 and portions of midfoot region 12. In such configurations, part of peripheral bond 90 may be secured to an inner surface or an outer surface of material element 56. Chamber element 54 may then form at least 80 percent of an exterior surface of upper 20 in midfoot region 12 and heel region 13. In such configurations, chamber element 54 may also include a backing material applied to at least part of its inner surface, which may advantageously modify the tactile properties of the inner surface, for the wearer's comfort.

Third Upper and Chamber Element Configuration

FIGS. 16-18B depict a third configuration of footwear 10 and an upper and chamber element incorporated therein. As depicted, chamber element 54 includes first barrier layer 58 and second barrier layer 59 that define top subchambers 71, bottom subchambers 72, front subchambers 73, rear subchamber 74, and internal conduits 88.

In comparison with chamber element 54 of FIGS. 10-15, first barrier layer 58 and second barrier layer 59 are depicted in FIGS. 16-18B as additionally defining a central subchamber 76. More specifically, barrier layers 58 and 59 are bonded at bonded areas 75, portions of which extend around central subchamber 76. Bonded areas 75 accordingly define a peripheral shape of central subchamber 76, as well as peripheral shapes of subchambers 71-74 and internal conduits 88. Positioning central subchamber 76 between subchambers 71-74 may advantageously allow chamber element 54 to be more resistant to deforming or stressing forces, and to better conform to a wearer's foot.

Fourth Upper and Chamber Element Configuration

FIGS. 19-23—depict a fourth configuration of footwear 10 and an upper and chamber element incorporated therein. The chamber element includes a first barrier layer and a second barrier layer that define top subchambers 71, bottom subchambers 72, front subchambers 73, and rear subchamber 74. In comparison with chamber element 54 of FIGS. 10-15, the first barrier layer and second barrier layer of the chamber element of FIGS. 19-23 additionally define underfoot subchambers 77, one on lateral side 14, and one on medial side 15.

Underfoot subchambers 77 extend underneath the interior void defined by the upper, and are positioned to extend through midfoot region 12 and heel region 13 on both lateral side 14 and medial side 15 of footwear 10. Underfoot subchambers 77 may thus extend underneath an arch area and rear portions of a foot securely received within the interior void. More particularly, underfoot subchambers 77 may extend under tarsus area 120 and calcaneus bone area 122 of the foot of a wearer. Underfoot subchambers 77 may accordingly extend through portions of footwear 10 positioned beneath and associated with tarsus area 120 and calcaneus bone area 122 of the foot of a wearer.

In these positions, underfoot subchambers 77 (in combination with subchambers 71-74) may advantageously increase a stability of footwear 10 in positions corresponding with the bones, joints, and ligaments of the ankle. In addition, subchambers 77 may enhance a fit of an interior surface of footwear 10 against a bottom surface of a wearer's foot.

Subchambers 77 are formed to naturally extend under the interior void when the chamber element is incorporated within footwear 10 to wrap around the ankle area of a wearer's foot. That is, subchambers 77 are molded or otherwise pre-contoured to extend inward from an exterior of footwear 10 when the chamber element is incorporated within footwear 10. In alternate configurations, underfoot subchambers 77 may instead be formed to naturally extend toward an exterior of footwear 10, and may be rotated inward and upward in order to position them under the interior void when the chamber element is incorporated within footwear 10.

Underfoot subchambers 77 are depicted as being exposed to an exterior of footwear 10, and as forming part of an exterior surface of footwear 10 in midfoot region 12 and heel region 13. However, other configurations are also possible. For example, subchambers 77 may be partially or entirely surrounded by, encased within, or otherwise embedded within a polymer foam material of the midsole. In some configurations, all of the outward-facing side surfaces of subchambers 77 may form part of an exterior surface of footwear 10. In other configurations, only part of the outward-facing side surfaces of subchambers 77 may form portions of an exterior surface of footwear 10. In still further configurations, the outward-facing side surfaces of subchambers 77 may be entirely unexposed to an exterior of footwear 10, and may thus form no part of the exterior surface of footwear 10.

In addition, underfoot chambers 77 are depicted as not being in fluid communication with subchambers 71-74, and as being separately pressurized or inflated. In various other configurations, however, underfoot subchambers 77 may be in fluid communication with one or more of top subchambers 71, bottom subchambers 72, front subchambers 73, and rear subchamber 74 (through inflation conduits, for example). In other words, in various configurations, underfoot subchambers 77 may or may not be in fluid communication with one or more of the other subchambers of the chamber element.

Further Configurations

Although depicted in FIGS. 1-5C as having apertures 31-34 in particular locations along outer layer 27, and as having subchambers 41-44 in particular locations along chamber element 24, various configurations of footwear 10 may incorporate different numbers of apertures and subchambers, and may incorporate apertures and subchambers in different positions.

Some configurations of footwear 10, for example, may include only rear aperture 34 and rear subchamber 44 extending through it, positioned to extend behind the Achilles tendon of a wearer's foot. Other configurations may additionally include top apertures 31, top subchambers 41, bottom apertures 32, and bottom subchambers 42, positioned near lateral and medial sides of the Achilles tendon of a wearer's foot. In such configurations, subchambers 41, 42, and 44 may make chamber element 24 more resistant to stressing forces around the Achilles tendon, and may in turn improve the stability of footwear 10 and its capacity to that area of the foot.

Other configurations of footwear 10 may include only apertures 31-33 and corresponding subchambers 41-43, on lateral side 14, medial side 15, or both. In such configurations, subchambers 41-43 and interior bond 45 between them may make chamber element 24 more resistant to stressing forces around the corresponding side or sides of the foot, and may in turn improve the stability of footwear 10 and its capacity to conform to the foot in that area or those areas.

More generally, in various configurations, footwear 10 may include any number of apertures and corresponding subchambers positioned to be near any area or areas of a wearer's foot, on either lateral side 14, medial side 15, or both, and in any of forefoot region 11, midfoot region 12, and heel region 13. For example, footwear 10 may include a rear aperture 34 and a rear subchamber 44, and may also include one or more additional apertures and corresponding subchambers located in any of a variety of positions along chamber element 24.

Figure 24:
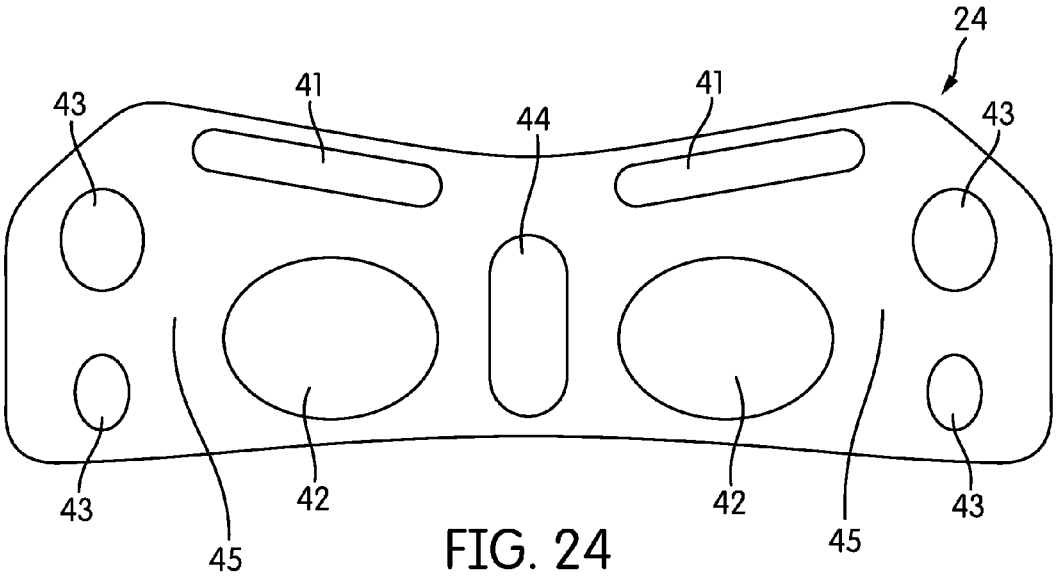
FIG. 24 is a top plan view corresponding with FIG. 7 and depicting a further configuration of the chamber element.

Although subchambers 41-44 are depicted in FIGS. 1-7 as having substantially rectangular and triangular configurations, chamber element 24 may be formed to define subchambers having any of a variety of shapes and sizes. For example, as depicted in FIG. 24, subchambers 42 and 43 are defined to have substantially oval shapes, while subchambers 41 and 44 are defined to have elongate shapes with rounded ends. Outer layer 27 may also be formed to define apertures having a variety of shapes and sizes, which may correspond with various shapes and sizes of subchambers 41-44. Any shape, size or design for the apertures in outer layer 27 or the subchambers of chamber element 24 is considered to be within the scope of the invention.

As depicted in FIGS. 1-5C, subchambers 41-44 protrude through apertures 31-34 to form parts of an exterior surface of footwear 10. Other portions of chamber element 24 may be exposed through apertures in outer layer 27, however. In some configurations, for example, outer layer 27 may include one or more apertures through which bonded areas of chamber element 24, such as interior bonds 45, are exposed.

At the same time, portions of chamber element 24 other than subchambers 41-44 may protrude through apertures 31-34. For example, interior bonds 45 may be formed to have protrusions that do not contact and lie flush against inner layer 26, but instead extend through apertures in outer layer 27. Accordingly, in various configurations, protrusions extending through outer layer 27 may be formed by subchambers 41-44 or may be otherwise formed in chamber element 24.

Figure 25A:
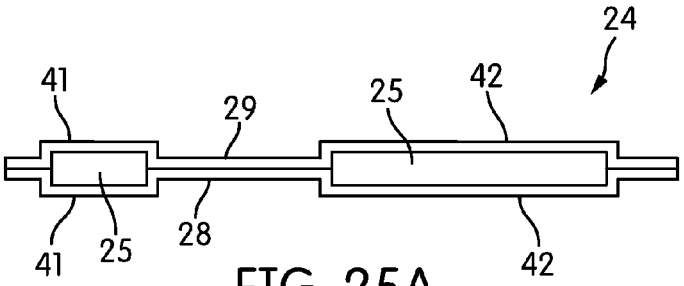
FIGS. 25A-25B are cross-sectional views corresponding with FIG. 8 and depicting further configurations of the chamber element.
Figure 25B:
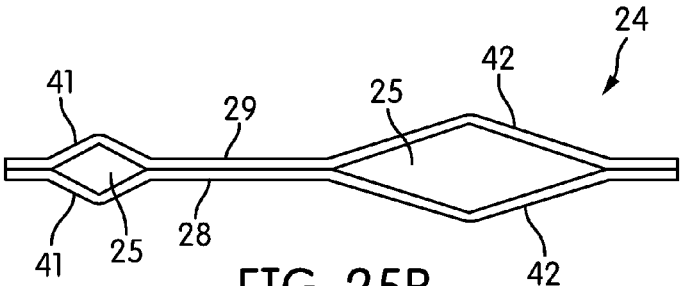

FIGS. 1-8 depict subchambers 41-44 as having substantially V-shaped cross-sectional configurations on one side (i.e., as extending outward toward a point or peak), and as bowing slightly outward on an opposite side. Subchambers 41-44 may have other cross-sectional configurations, though. As an example, FIG. 25A depicts an alternate configuration of chamber element 24 in which subchambers 41 and 42 have substantially rectangular cross-sectional configurations extending outward on both sides. As a further example, FIG. 25B depicts another alternate configuration of chamber element 24 in which subchambers 41 and 42 extend toward a point or peak in on both sides. Similarly, in some alternate configurations, subchambers formed in chamber element 24 may bow slightly outward on both sides. Accordingly, in various configurations, subchambers 41-44 may have any of a variety of cross-sectional configurations.

Figure 26A:
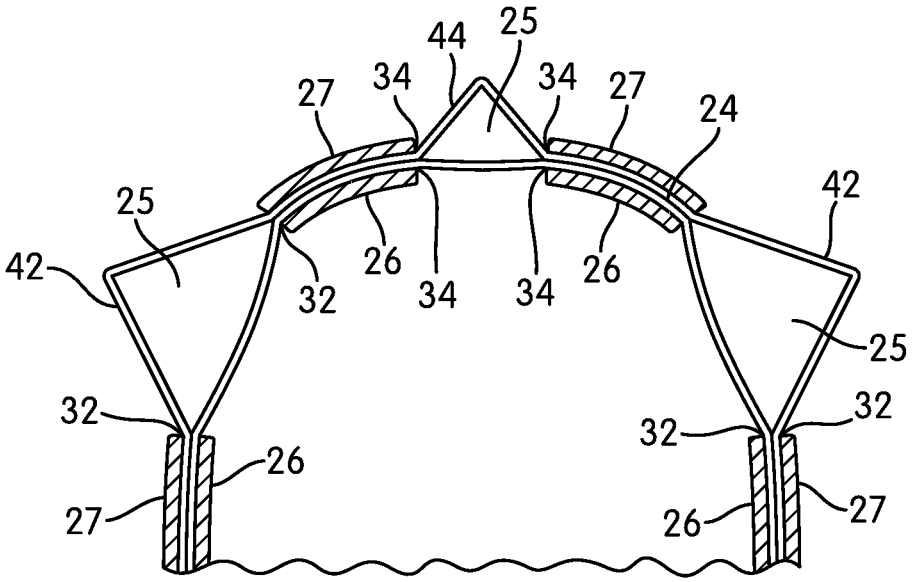
FIGS. 26A-26B are cross-sectional views corresponding with FIG. 6B and depicting further configurations of the chamber element.
Figure 26B:
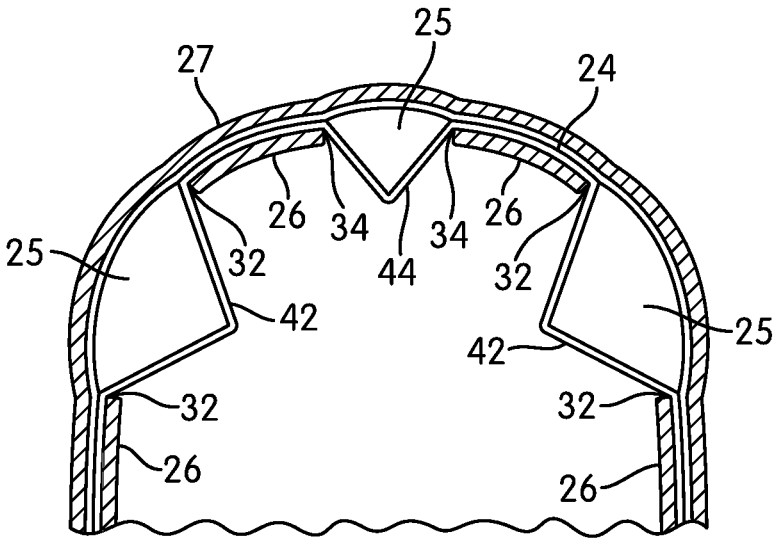

Furthermore, although FIGS. 1-8 depict outer layer 27 as having apertures through which subchambers of chamber element 24 extend, and depict inner layer 26 as being in contact with and flush against substantially all of chamber element 24, footwear 10 may be otherwise configured. For example, as depicted in FIG. 26A, both inner layer 26 and outer layer 27 may include apertures, and subchambers 41-44 may extend through the apertures in inner layer 26 as well as through the apertures in outer layer 27. Alternatively, inner layer 26 may have a plurality of apertures while outer layer 27 may be substantially continuous and without apertures. In one such configuration, as depicted in FIG. 26B, subchambers 41-44 may extend inward toward a foot of a wearer, while forming slight bulges in an exterior surface of footwear 10 where the subchambers bow slightly outward and are in contact with and flush against outer layer 27.

Chamber element 24 may also be a single fluid-filled chamber, and a portion or portions of chamber element 24 may be exposed through one or more apertures in outer layer 27 to form one or more portions of an exterior surface of footwear 10. Similarly, one or more portions of chamber element 24 may protrude at least partially through apertures in outer layer 27. In such configurations, the size and shape of each exposed or protruding portion of chamber element 24 may be defined by the size and shape of the various apertures in outer layer 27. Various portions of an exterior surface of footwear 10 may accordingly be formed by portions of chamber element 24 exposed through apertures in outer layer 27, or by portions of chamber element 24 protruding through apertures in outer layer 27.

In some configurations, chamber element 24 may be incorporated into a fluid-filled system for footwear 10 along with one or more fluid-filled chambers in sole structure 50, such as one or more fluid-filled chambers within a midsole. Furthermore, chamber element 24 may be part of an inflatable system in which pumps, conduits, and valves may pressurize or inflate chamber element 24 with air from the exterior of footwear 10. In addition, subchambers 41-44 may be in fluid communication with each other through internal conduits, and the movement of a wearer's foot within footwear 10 may decrease a volume of one or more of subchambers 41-44 and, in turn, increase a fluid pressure (and potentially a volume) of one or more other subchambers. That is, for configurations in which one or more subchambers 41-44 are in fluid communication, movements of a wearer's foot against some subchambers may adjust the level of inflation in other subchambers, which may in turn allow for the provision of stability and support to various areas of footwear 10 as needed.

While various embodiments of the invention have been described, the description is intended to be exemplary, rather than limiting and it will be apparent to those of ordinary skill in the art that many more embodiments and implementations are possible that are within the scope of the invention. For example, aspects of the various configurations of the uppers and chamber elements incorporated therein, as described above and as depicted herein, may be combined. Accordingly, the invention is not to be restricted except in light of the attached claims and their equivalents. Also, various modifications and changes may be made within the scope of the attached claims.

What is claimed is:

1. An article of footwear having an upper and a sole structure, the upper defining an interior void for receiving a foot of a wearer and comprising:

an outer layer forming part of an exterior surface of the footwear and having a plurality of outer apertures, at least one of the outer apertures being positioned at a rearward-facing portion of a heel region of the footwear;

an inner layer positioned adjacent the interior void and forming part of an interior surface of the footwear, the inner layer having a plurality of inner apertures; and a fluid-filled chamber element positioned at least partially between the outer layer and the inner layer, the chamber element including:

an interior bond positioned on one of a lateral side of the upper and a medial side of the upper, and a plurality of subchambers positioned adjacent to at least fifty percent of a periphery of the interior bond, the subchambers being in fluid communication with each other, and each of the subchambers protruding at least partially through one of the plurality of outer apertures and each of the subchambers protruding at least partially through one of the plurality of inner apertures.

2. The article of footwear of claim 1, wherein the interior bond extends across at least twenty percent of an area of the chamber element.

3. The article of footwear of claim 1, wherein the interior bond extends across at least fifty percent of a height of the chamber element and extends across at least twenty-five percent of a width of the chamber element.

4. The article of footwear of claim 1, wherein the chamber element surrounds the heel region.

5. The article of footwear of claim 1, wherein the chamber element is formed from a transparent colored polymer material.

6. The article of footwear of claim 1, wherein the chamber element includes an additional interior bond and an additional plurality of subchambers adjacent to at least fifty percent of a periphery of the additional interior bond.

7. An article of footwear having an upper and a sole structure, the upper defining an interior void for receiving a foot of a wearer and comprising:

an outer layer forming part of an exterior surface of the footwear and having a plurality of outer apertures, at least one of the apertures being positioned at a rearward-facing portion of a heel region of the footwear;

an inner layer positioned adjacent the interior void and forming part of an interior surface of the footwear and having a plurality of inner apertures; and a fluid-filled chamber element at least partially formed from a transparent colored polymer material, the chamber element being positioned at least partially between the outer layer and the inner layer, and the chamber element including a heel subchamber, a plurality of lateral subchambers, a plurality of medial subchambers, a lateral internal bond, and a medial internal bond, wherein the heel subchamber and the plurality of lateral subchambers are adjacent to at least fifty percent of a periphery of the lateral internal bond, and the heel subchamber and the plurality of medial subchambers are adjacent to at least fifty percent of a periphery of the medial internal bond;

wherein at least one of the plurality of lateral subchambers protrudes at least partially through one of the plurality of inner apertures;

wherein the chamber element is configured to support an ankle of a wearer; and wherein the chamber element is configured to extend around an Achilles tendon area and a calcaneus bone area of the wearer.

8. The article of footwear of claim 7, wherein the heel subchamber has an elongate configuration.

9. The article of footwear of claim 7, wherein a plurality of the medial subchambers have a triangular configuration and a plurality of the lateral subchambers have a triangular configuration.

10. The article of footwear of claim 7, wherein the chamber element surrounds the heel region.

11. The article of footwear of claim 7, wherein the medial internal bond and the lateral internal bond each extend across at least twenty percent of an area of the chamber element.

12. The article of footwear of claim 7, wherein the medial internal bond and the lateral internal bond each extend across at least fifty percent of a height of the chamber element and extend across at least twenty-five percent of a width of the chamber element.

13. An article of footwear having an upper and a sole structure, the upper defining an interior void for receiving a foot of a wearer and comprising:

a material layer having a forward portion that forms part of an exterior surface of the upper in a forefoot region of the footwear; and a fluid-filled chamber element that forms part of the exterior surface of the upper in both a midfoot region of the footwear and a heel region of the footwear, the chamber element having a first barrier layer and a second barrier layer that define a plurality of subchambers, each subchamber being exposed to an exterior of the footwear and being at least partially formed from a colored material;

the upper including an exterior layer and an interior layer, the exterior layer including a plurality of exterior apertures and the interior layer including a plurality of interior apertures that align with the plurality of exterior apertures;

wherein each of the plurality of subchambers protrudes at least partially through a respective one of the plurality of exterior apertures as well as protrudes at least partially through a respective one of the plurality of interior apertures.

14. The article of footwear of claim 13, wherein at least one of the first barrier layer and the second barrier layer includes a colored portion.

15. The article of footwear of claim 13, wherein at least one of the first barrier layer and the second barrier layer is a colored polymer material.

16. The article of footwear of claim 13, wherein the colored material is a transparent polymer material.

17. The article of footwear of claim 13, wherein the chamber element is formed from a transparent colored polymer material.

18. The article of footwear of claim 13, wherein the chamber element surrounds the heel region.

19. The article of footwear of claim 13, wherein the plurality of subchambers are in fluid communication with each other.

20. The article of footwear of claim 13, wherein the chamber element includes an upwardly-extending inflation conduit located in the heel region.

21. The article of footwear of claim 13, wherein the chamber element includes a peripheral bond extending around the subchambers.

22. The article of footwear of claim 21, wherein the forward portion at least partially overlaps portions of the peripheral bond.

23. The article of footwear of claim 21, wherein the peripheral bond includes a plurality of notches separating a plurality of flaps, and the flaps are secured to the sole structure.

* * * * *